US009911390B2

(12) United States Patent
Yamagishi et al.

(10) Patent No.: US 9,911,390 B2
(45) Date of Patent: Mar. 6, 2018

(54) LIQUID CRYSTAL DISPLAY DEVICE

(71) Applicant: Sharp Kabushiki Kaisha, Osaka-shi, Osaka (JP)

(72) Inventors: Maremu Yamagishi, Osaka (JP); Akizumi Fujioka, Osaka (JP); Kazuki Takahashi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 151 days.

(21) Appl. No.: 14/916,637

(22) PCT Filed: Aug. 22, 2014

(86) PCT No.: PCT/JP2014/072023
§ 371 (c)(1),
(2) Date: Mar. 4, 2016

(87) PCT Pub. No.: WO2015/033802
PCT Pub. Date: Mar. 12, 2015

(65) Prior Publication Data

US 2016/0232863 A1 Aug. 11, 2016

(30) Foreign Application Priority Data

Sep. 5, 2013 (JP) ..... 2013-184181

(51) Int. Cl.
*G09G 5/00* (2006.01)
*G09G 3/36* (2006.01)

(52) U.S. Cl.
CPC ..... *G09G 3/3614* (2013.01); *G09G 3/3659* (2013.01); *G09G 3/3677* (2013.01);
(Continued)

(58) Field of Classification Search
CPC .. G09G 3/3614; G09G 3/3659; G09G 3/3677; G09G 3/3685; G09G 2320/0247;
(Continued)

(56) References Cited

U.S. PATENT DOCUMENTS 8,669,556 B2 * 3/2014 Yamazaki ..... H01L 29/7869 257/43
8,810,615 B2 * 8/2014 Takahashi ..... G09G 3/3611 345/691
8,963,912 B2 * 2/2015 Yukawa ..... G09G 3/3614 345/215
9,007,287 B2 * 4/2015 Kitayama ..... G09G 3/003 345/690
(Continued)

FOREIGN PATENT DOCUMENTS

JP 2001-042287 A 2/2001
JP 2001-312253 A 11/2001
(Continued)

OTHER PUBLICATIONS

Official Communication issued in International Patent Application No. PCT/JP2014/072023, dated Nov. 25, 2014.

*Primary Examiner* — Vijay Shankar
(74) *Attorney, Agent, or Firm* — Keating & Bennett, LLP

(57) ABSTRACT

A liquid crystal display device (100) includes: a liquid crystal display panel (10); a scan line driving circuit (20) that supplies a scan signal voltage to each pixel (Px) via a corresponding scan line (11); a signal line driving circuit (30) that supplies a display signal voltage to each pixel via a corresponding signal line (12); and a display control section (40) including a polarity reversal driving switching section (41) that switches a mode of polarity reversal of the display signal voltage. In a case where the polarity reversal driving switching section switches the polarity reversal mode in transition from a first vertical scan period to a second vertical scan period immediately succeeding the first vertical scan period, the display control section is capable of making a largeness of a display signal voltage supplied in the second vertical scan period different from its original
(Continued)

largeness only for a pixel group included in the plurality of pixels to which display signal voltages that have the same polarity in both the first and second vertical scan periods are supplied.

16 Claims, 23 Drawing Sheets

(52) U.S. Cl.
CPC ... *G09G 3/3685* (2013.01); *G09G 2300/0478* (2013.01); *G09G 2300/0809* (2013.01); *G09G 2320/0247* (2013.01); *G09G 2330/02* (2013.01)

(58) Field of Classification Search
CPC ... G09G 2300/0478; G09G 2300/0809; G09G 2330/02
See application file for complete search history.

(56) References Cited

U.S. PATENT DOCUMENTS

| | | | | |
|---|---|---|---|---|
| 9,214,120 | B2 * | 12/2015 | Nakanishi | G09G 3/3614 |
| 9,311,872 | B2 * | 4/2016 | Takahashi | G09G 3/3614 |
| 2012/0127153 | A1 | 5/2012 | Yukawa | |
| 2012/0138922 | A1 | 6/2012 | Yamazaki et al. | |
| 2013/0057791 | A1 | 3/2013 | Kitayama et al. | |
| 2014/0071105 | A1 | 3/2014 | Nakanishi et al. | |
| 2014/0225881 | A1 | 8/2014 | Takahashi et al. | |

FOREIGN PATENT DOCUMENTS

| | | | |
|---|---|---|---|
| JP | 2012-134475 | A | 7/2012 |
| JP | 2014-056091 | A | 3/2014 |
| WO | 2011/007613 | A1 | 1/2011 |
| WO | 2011/145584 | A1 | 11/2011 |
| WO | 2013/024754 | A1 | 2/2013 |

* cited by examiner

*FIG.1*

COLUMN REVERSAL MODE

| | R | G | B | R | G | B |
|---|---|---|---|---|---|---|
| | 1 | 2 | 3 | 4 | 5 | 6 |
| Px 1 | + | − | + | − | + | − |
| Px 2 | + | − | + | − | + | − |
| 3 | + | − | + | − | + | − |
| 4 | + | − | + | − | + | − |
| 5 | + | − | + | − | + | − |
| 6 | + | − | + | − | + | − |

*FIG.2*

DOT REVERSAL MODE

| | R | G | B | R | G | B |
|---|---|---|---|---|---|---|
| | 1 | 2 | 3 | 4 | 5 | 6 |
| Px 1 | + | − | + | − | + | − |
| Px 2 | − | + | − | + | − | + |
| 3 | + | − | + | − | + | − |
| 4 | − | + | − | + | − | + |
| 5 | + | − | + | − | + | − |
| 6 | − | + | − | + | − | + |

*FIG.3*

2H DOT REVERSAL MODE

| | R | G | B | R | G | B |
|---|---|---|---|---|---|---|
| | 1 | 2 | 3 | 4 | 5 | 6 |
| Px 1 | + | − | + | − | + | − |
| Px 2 | + | − | + | − | + | − |
| 3 | − | + | − | + | − | + |
| 4 | − | + | − | + | − | + |
| 5 | + | − | + | − | + | − |
| 6 | + | − | + | − | + | − |

*FIG.4*

4H DOT REVERSAL MODE

| | R | G | B | R | G | B |
|---|---|---|---|---|---|---|
| | 1 | 2 | 3 | 4 | 5 | 6 |
| Px 1 | + | − | + | − | + | − |
| Px 2 | + | − | + | − | + | − |
| 3 | + | − | + | − | + | − |
| 4 | + | − | + | − | + | − |
| 5 | − | + | − | + | − | + |
| 6 | − | + | − | + | − | + |
| 7 | − | + | − | + | − | + |
| 8 | − | + | − | + | − | + |

*FIG.5*

SHIFTED 2H DOT REVERSAL MODE

| | R | G | B | R | G | B |
|---|---|---|---|---|---|---|
| | 1 | 2 | 3 | 4 | 5 | 6 |
| Px 1 | + | − | + | − | + | − |
| Px 2 | − | + | − | + | − | + |
| 3 | − | + | − | + | − | + |
| 4 | + | − | + | − | + | − |
| 5 | + | − | + | − | + | − |
| 6 | − | + | − | + | − | + |
| 7 | − | + | − | + | − | + |

*FIG.6*

SHIFTED 4H DOT REVERSAL MODE

| | R | G | B | R | G | B |
|---|---|---|---|---|---|---|
| | 1 | 2 | 3 | 4 | 5 | 6 |
| Px 1 | + | − | + | − | + | − |
| Px 2 | − | + | − | + | − | + |
| 3 | − | + | − | + | − | + |
| 4 | − | + | − | + | − | + |
| 5 | − | + | − | + | − | + |
| 6 | + | − | + | − | + | − |
| 7 | + | − | + | − | + | − |
| 8 | + | − | + | − | + | − |
| 9 | + | − | + | − | + | − |

(a)

(b)

LIQUID CRYSTAL DISPLAY DEVICE

TECHNICAL FIELD

The present invention relates to a liquid crystal display device.

BACKGROUND ART

Liquid crystal display devices, which are characterized by very small thickness and low power consumption, are now widely used in various devices, such as notebook personal computers, cell phones, and smartphones. Recently, still lower power consumption has been demanded of the liquid crystal display devices.

As the technique for further reducing the power consumption of the liquid crystal display devices, intermittent driving (or "low frequency driving") in which driving is performed with the image rewriting frequency (driving frequency) being lower than those employed in conventional liquid crystal display devices has been proposed (for example, Patent Document 1). In the intermittent driving, one frame includes periods where a display signal voltage (source voltage) is supplied to pixels and periods where no display signal voltage is supplied to pixels. In the latter periods (pause periods), it is not necessary to supply electric power to gate drivers and source drivers, resulting in lower power consumption.

However, decreasing the driving frequency (i.e., reducing the number of frames per unit time) makes flicker more readily perceivable. Perception of flicker deteriorates the display quality.

In view of such, Patent Document 2 proposes the technique of switching the mode of polarity reversal of the display signal voltage at the timing of switching between the normal driving and the intermittent driving (at the timing of switching the driving frequency). In a normal driving operation, a polarity reversal mode which requires small power consumption such as the column reversal mode is used, while in an intermittent driving operation a polarity reversal mode which provides an excellent flicker suppression effect such as dot reversal mode is used, whereby it is expected that both lower power consumption and high quality display can be achieved.

CITATION LIST

Patent Literature

Patent Document 1: Japanese Laid-Open Patent Publication No. 2001-312253

Patent Document 2: WO 2013/024754

SUMMARY OF INVENTION

Technical Problem

However, the present inventors carried out detailed research and found that when the polarity reversal mode is switched, an unintended luminance variation (e.g., an increase in luminance) occurs in some pixels immediately after the switching so that flicker is perceived, resulting in deterioration of the display quality.

The present invention was conceived in view of the above problems. An object of the present invention is to provide a liquid crystal display device in which deterioration of the display quality at the timing of switching the polarity reversal mode is suppressed.

Solution to Problem

A liquid crystal display device according to an embodiment of the present invention includes: a liquid crystal display panel having a plurality of pixels arranged in a matrix which has a plurality of rows and a plurality of columns, the liquid crystal display panel having a plurality of scan lines extending in a row direction and a plurality of signal lines extending in a column direction; a scan line driving circuit that supplies a scan signal voltage to each of the plurality of pixels via a corresponding scan line; a signal line driving circuit that supplies a display signal voltage to each of the plurality of pixels via a corresponding signal line; and a display control section including a polarity reversal driving switching section that switches a mode of polarity reversal of the display signal voltage, wherein in a case where the polarity reversal driving switching section switches the mode of polarity reversal of the display signal voltage in transition from a first vertical scan period to a second vertical scan period immediately succeeding the first vertical scan period, the display control section is capable of making a largeness of a display signal voltage supplied in the second vertical scan period different from its original largeness only for a pixel group included in the plurality of pixels to which display signal voltages that have the same polarity in both the first and second vertical scan periods are supplied.

In one embodiment, the display control section is capable of making a largeness of a display signal voltage supplied to the pixel group in the second vertical scan period smaller than its original largeness.

In one embodiment, the display control section is capable of making a largeness of a display signal voltage supplied to the pixel group in the second vertical scan period greater than its original largeness.

In one embodiment, the display control section makes a largeness of a display signal voltage supplied to the pixel group in the second vertical scan period different from its original largeness by 0.86% or more in terms of transmittance.

In one embodiment, the display control section further includes an unreversed pixel identifying section that identifies, from among the plurality of pixels, the pixel group to which display signal voltages that have the same polarity in both the first and second vertical scan periods are supplied.

In one embodiment, the display control section further includes an undershoot circuit that makes a display signal voltage supplied in the second vertical scan period to the pixel group identified by the unreversed pixel identifying section smaller than its original largeness or an overshoot circuit that makes a display signal voltage supplied in the second vertical scan period to the pixel group identified by the unreversed pixel identifying section greater than its original largeness.

A liquid crystal display device according to another embodiment of the present invention includes: a liquid crystal display panel having a plurality of pixels arranged in a matrix which has a plurality of rows and a plurality of columns, the liquid crystal display panel having a plurality of scan lines extending in a row direction and a plurality of signal lines extending in a column direction; a scan line driving circuit that supplies a scan signal voltage to each of the plurality of pixels via a corresponding scan line; a signal line driving circuit that supplies a display signal voltage to each of the plurality of pixels via a corresponding signal line; and a display control section including a polarity reversal driving switching section that switches a mode of polarity reversal of the display signal voltage, wherein the display control section is capable of carrying out a voltage adjustment so as to make a largeness of a display signal voltage supplied to the plurality of pixels different from its original largeness, and in a case where the polarity reversal driving switching section switches the mode of polarity reversal of a display signal voltage in transition from a first vertical scan period to a second vertical scan period immediately succeeding the first vertical scan period, a pixel group included in the plurality of pixels to which display signal voltages that have the same polarity in both the first vertical scan period and the second vertical scan period are supplied is referred to as a first pixel group, and a pixel group included in the plurality of pixels to which display signal voltages that have opposite polarities in the first vertical scan period and the second vertical scan period are supplied is referred to as a second pixel group, the display control section is capable of making a voltage adjustment amount for a display signal voltage supplied to the first pixel group in the second vertical scan period and a voltage adjustment amount for a display signal voltage supplied to the second pixel group in the second vertical scan period different from each other.

In one embodiment, the liquid crystal display device which has the above-described configuration is capable of carrying out intermittent driving in which a signal supply period where a display signal voltage is supplied to each of the plurality of pixels and a pause period where no display signal voltage is supplied to each of the plurality of pixels are provided within one frame.

In one embodiment, the liquid crystal display device which has the above-described configuration is capable of being switched between normal driving in which the pause period is not provided in one frame and the intermittent driving, and in switching between the normal driving and the intermittent driving, the polarity reversal driving switching section switches the mode of polarity reversal of a display signal voltage.

In one embodiment, the liquid crystal display panel includes a thin film transistor provided in each of the plurality of pixels, and the thin film transistor includes a semiconductor layer which includes an oxide semiconductor.

In one embodiment, the oxide semiconductor includes an In—Ga—Zn—O based semiconductor.

In one embodiment, the In—Ga—Zn—O based semiconductor includes a crystalline portion.

Advantageous Effects of Invention

According to an embodiment of the present invention, a liquid crystal display device is provided in which deterioration of the display quality at the timing of switching the polarity reversal mode is suppressed.

BRIEF DESCRIPTION OF DRAWINGS

FIG. 1 A diagram showing the polarity of display signal voltages supplied to respective pixels Px in a column reversal mode.

FIG. 2 A diagram showing the polarity of display signal voltages supplied to respective pixels Px in a dot reversal mode.

FIG. 3 A diagram showing the polarity of display signal voltages supplied to respective pixels Px in a 2H dot reversal mode.

FIG. 4 A diagram showing the polarity of display signal voltages supplied to respective pixels Px in a 4H dot reversal mode.

FIG. 5 A diagram showing the polarity of display signal voltages supplied to respective pixels Px in a shifted 2H dot reversal mode.

FIG. 6 A diagram showing the polarity of display signal voltages supplied to respective pixels Px in a shifted 4H dot reversal mode.

DESCRIPTION OF EMBODIMENTS

Figure 7:
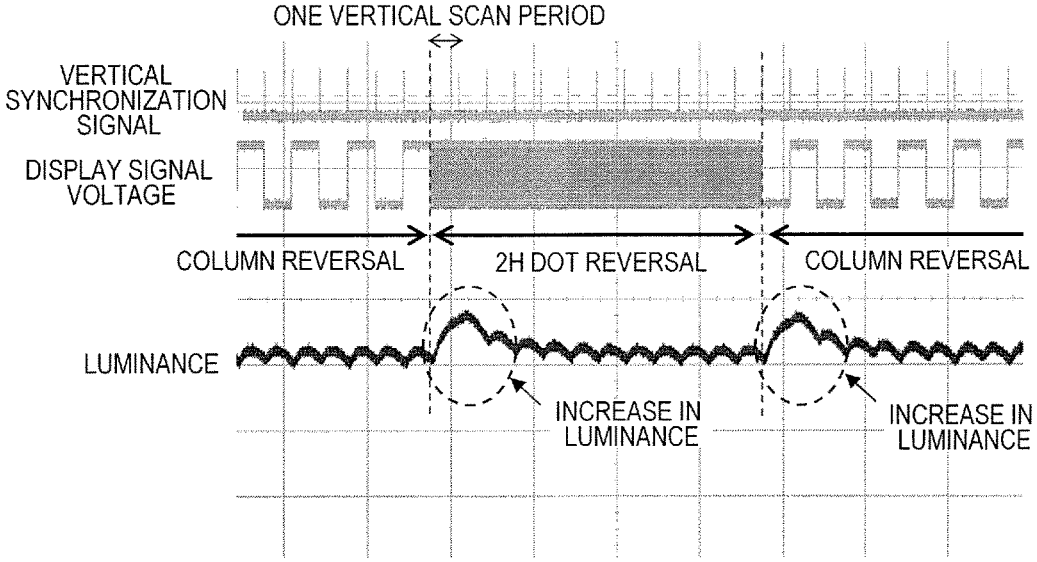
FIG. 7 A chart illustrating luminance variation of an unreversed pixel which occurs when the polarity reversal mode is switched in a normally black mode liquid crystal display device.

First, various polarity reversal modes (polarity reversal driving) and deterioration in display quality which can occur when the polarity reversal mode is switched are described prior to description of embodiments of the present invention.

FIG. 1 to FIG. 4 show the polarity of display signal voltages (source voltages) supplied to respective pixels Px in "column reversal mode", "dot reversal mode", "2H dot reversal mode" and "4H dot reversal mode", respectively. Note that FIG. 1 to FIG. 4 also show the pixel row number and the pixel column number. In FIG. 1 to FIG. 4, "R", "G" and "B" mean pixel columns corresponding to red pixels, green pixels and blue pixels, respectively (the same applies to the subsequent drawings).

In the column reversal mode (also referred to as "source line reversal mode"), reversal driving is performed such that, as shown in FIG. 1, display signal voltages at two arbitrary neighboring pixel rows have different polarities. That is, the polarity of the display signal voltage is reversed every pixel along the row direction but not reversed along the column direction.

In the dot reversal mode, reversal driving is performed such that, as shown in FIG. 2, display signal voltages at two arbitrary neighboring pixels have different polarities. That is, the polarity of the display signal voltage is reversed every pixel along the row direction and is also reversed every pixel along the column direction.

In the 2H dot reversal mode, reversal driving is performed such that, as shown in FIG. 3, it can be regarded as the dot reversal mode for every two pixel rows (2H). That is, the polarity of the display signal voltage is reversed every pixel along the row direction and is also reversed every two pixels along the column direction.

In the 4H dot reversal mode, reversal driving is performed such that, as shown in FIG. 4, it can be regarded as the dot reversal mode for every four pixel rows (4H). That is, the polarity of the display signal voltage is reversed every pixel along the row direction and is also reversed every four pixels along the column direction. Note that the dot reversal mode illustrated in FIG. 2 is also referred to as "1H dot reversal mode" in comparison with the 2H dot reversal mode and the 4H dot reversal mode.

Also, there are modifications of the 2H dot reversal mode and the 4H dot reversal mode, such as shown in FIG. 5 and FIG. 6.

In the mode shown in FIG. 5, reversal driving is performed such that it can be regarded as the dot reversal mode for every two pixel rows as in the 2H dot reversal mode. Note that, however, in the mode illustrated in FIG. 5, the phase of the spatial frequency of the polarity reversal is shifted by one pixel row as compared with the 2H dot reversal mode (see FIG. 3). In this specification, such a polarity reversal mode is referred to as "shifted 2H dot reversal mode".

In the mode shown in FIG. 6, reversal driving is performed such that it can be regarded as the dot reversal mode for every four pixel rows as in the 4H dot reversal mode. Note that, however, in the mode illustrated in FIG. 6, the phase of the spatial frequency of the polarity reversal is shifted (here, by one pixel row although not limited to this example) as compared with the 4H dot reversal mode (see FIG. 4). In this specification, such a polarity reversal mode is referred to as "shifted 4H dot reversal mode".

Note that, in the polarity reversal modes illustrated in FIG. 1 to FIG. 6, commonly, the polarity of display signal voltages supplied to respective pixels Px are reversed every frame (every vertical scan period) (frame reversal).

As understood from the foregoing description provided with reference to FIG. 1 to FIG. 6, when the polarity reversal mode is different, the spatial frequency of the polarity reversal and/or its phase is also different. Therefore, in switching the polarity reversal mode, display signal voltages that have the same polarity in both a vertical scan period immediately preceding the switching and a vertical scan period immediately succeeding the switching are supplied to some of the pixels (e.g., about a half of the pixels). Hereinafter, such pixels are referred to as "unreversed pixels". A plurality of unreversed pixels which are present immediately after the switching are sometimes collectively referred to as "unreversed pixel group".

According to research conducted by the present inventors, it was found that an unintended luminance variation observed immediately after switching of the polarity reversal mode occurred in the above-described unreversed pixels. FIG. 7 illustrates luminance variation of an unreversed pixel which occurs when the polarity reversal mode is switched in a normally black mode liquid crystal display device. In the example illustrated in FIG. 7, the polarity reversal mode is once switched from the column reversal mode to the 2H dot reversal mode. After reversal driving is performed in the 2H dot reversal mode for a predetermined period (a period corresponding to 12 vertical scan periods), the polarity reversal mode is returned to the column reversal mode again. FIG. 7 also shows the vertical synchronization signal and the potential of a signal line (source bus line) corresponding to that unreversed pixel (i.e., display signal voltage).

It can be seen from FIG. 7 that an unintended increase in luminance occurs immediately after the switching from the column reversal mode to the 2H dot reversal mode and immediately after the switching from the 2H dot reversal mode to the column reversal mode. Such an increase in luminance causes flicker in display and deteriorates the display quality.

On the other hand, according to embodiments of the present invention, deterioration of the display quality at the timing of switching the polarity reversal mode is suppressed. Hereinafter, embodiments of the present invention are described with reference to the drawings. Note that the present invention is not limited to the embodiments described below.

Figure 8:
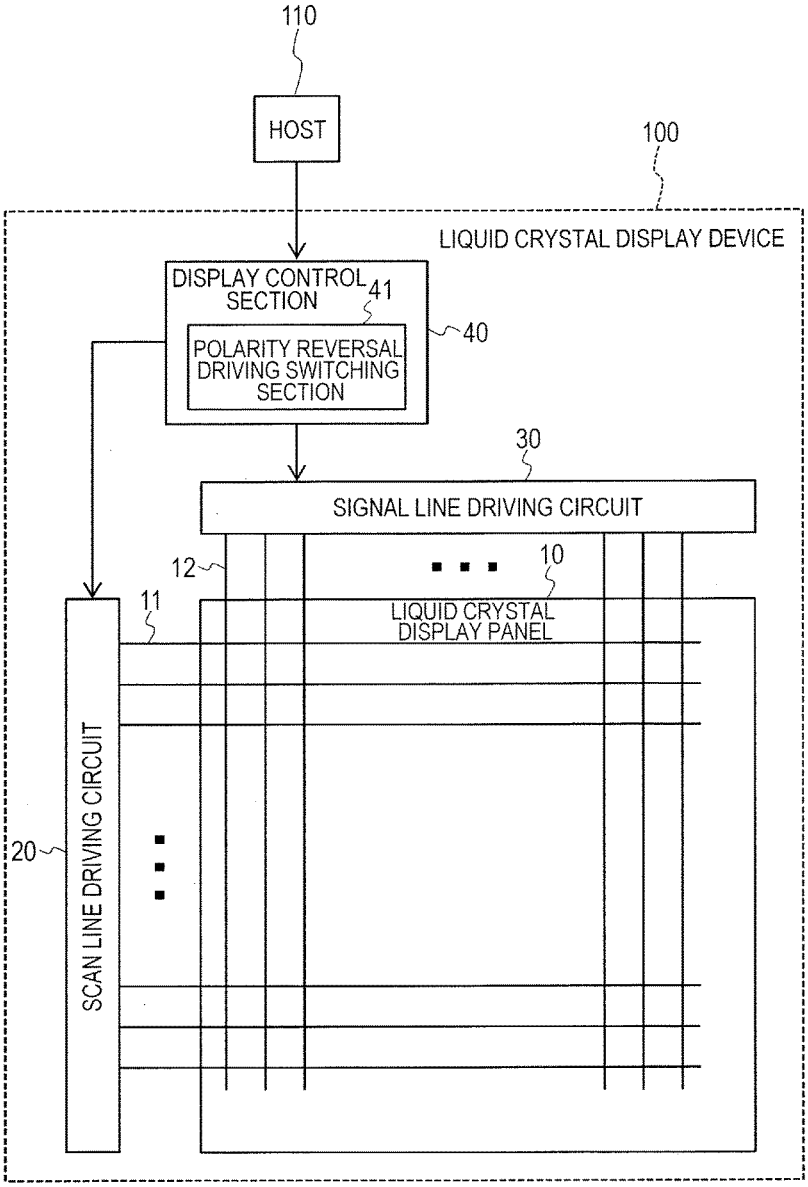
FIG. 8 (*a*) is a block diagram schematically showing a liquid crystal display device 100 according to an embodiment of the present invention. (*b*) is an equivalent circuit diagram of a region corresponding to one pixel Px.
Figure 8:
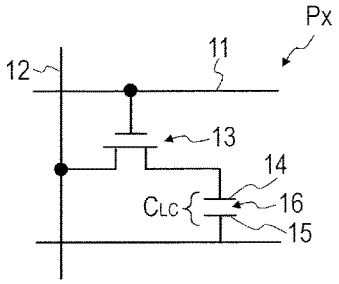

FIG. 8 shows a liquid crystal display device 100 according to an embodiment of the present invention. FIG. 8(*a*) is a block diagram schematically showing the liquid crystal display device 100. FIG. 8(*b*) is an equivalent circuit diagram of a region corresponding to one pixel Px. Here, the liquid crystal display device 100 is a normally black mode liquid crystal display device where black display is provided in the absence of a voltage across the liquid crystal layer.

The liquid crystal display device 100 includes, as shown in FIG. 8(*a*), a liquid crystal display panel 10, a scan line driving circuit (gate driver) 20, a signal line driving circuit (source driver) 30, and a display control section (timing controller) 40. Outside the liquid crystal display device 100, a host 110 which is mainly formed by a central processing unit (CPU) is provided.

The liquid crystal display panel 10 includes a plurality of pixels Px arranged in a matrix consisting of a plurality of rows and a plurality of columns. The liquid crystal display panel 10 includes a plurality of scan lines 11 extending in the row direction and a plurality of signal lines 12 extending in the column direction (i.e., so as to intersect the plurality of scan lines 11). Each of the plurality of pixels Px includes a thin film transistor (TFT) 13 and a pixel electrode 14 as shown in FIG. 8(*b*). The gate electrode, source electrode and drain electrode of the TFT 13 are electrically coupled with corresponding scan line 11, signal line 12 and pixel electrode 14, respectively. The liquid crystal display panel 10 further includes a common electrode 15 and a liquid crystal layer 16. The pixel electrode 14, the common electrode 15 and the liquid crystal layer 16 form liquid crystal capacitance $C_{LC}$.

The scan line driving circuit 20 supplies a scan signal voltage (gate voltage) to each of the plurality of pixels Px via a corresponding scan line (gate bus line) 11. Meanwhile, the signal line driving circuit 30 supplies a display signal voltage (source voltage) to each of the plurality of pixels Px via a corresponding signal line (source bus line).

The display control section 40 receives image data and a control signal from an external device (host 110). The display control section 40 generates various signals based on the received image data and control signal for controlling the scan line driving circuit 20 and the signal line driving circuit 30.

The display control section 40 includes a polarity reversal driving switching section 41 for switching the mode of polarity reversal of the display signal voltage. Here, a vertical scan period immediately preceding switching of the polarity reversal mode (polarity reversal driving) by the polarity reversal driving switching section 41 is referred to as "first vertical scan period", and a vertical scan period immediately succeeding the switching (i.e., immediately succeeding the first vertical scan period) is referred to as "second vertical scan period".

The display control section 40 is capable of making the largeness of the display signal voltage supplied in the second vertical scan period different from its original largeness (i.e., can carry out a voltage adjustment) only for unreversed pixels included in the plurality of pixels Px (a pixel group to which display signal voltages that have the same polarity in both the first and second vertical scan periods are supplied). Specifically, the display control section 40 is capable of making the largeness of the display signal voltages supplied to the unreversed pixel group in the second vertical scan period smaller than the original largeness (i.e., is capable of undershooting the display signal voltages).

Thus, in the liquid crystal display device 100, an unintended luminance increase immediately after switching of the polarity reversal mode and occurrence of flicker in display which is attributed to the unintended luminance increase can be prevented. Therefore, deterioration of the display quality can be suppressed.

Figure 9:
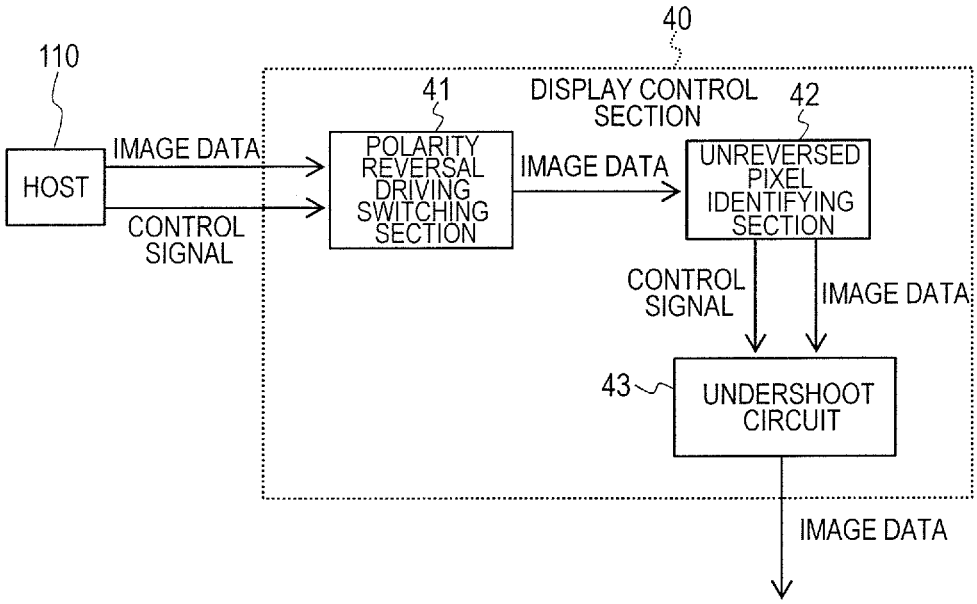
FIG. 9 A block diagram showing a specific configuration example of a display control section 40.

FIG. 9 shows a specific configuration example of a display control section 40. In the example illustrated in FIG. 9, the display control section 40 includes an unreversed pixel identifying section 42 and an undershoot circuit 43 in addition to the polarity reversal driving switching section 41. Note that, in FIG. 9, components which are also provided in common timing controllers are not shown.

The polarity reversal driving switching section 41 receives from the external device (host 110) image data and a control signal for switching the polarity reversal mode (polarity reversal switching signal) and then switches the polarity reversal mode. Meanwhile, the polarity reversal driving switching section 41 outputs the image data to the unreversed pixel identifying section 42.

The unreversed pixel identifying section 42 identifies, based on the input image data, an unreversed pixel group (a pixel group to which display signal voltages that have the same polarity in both the first and second vertical scan periods are supplied) from among the plurality of pixels Px. Then, the unreversed pixel identifying section 42 outputs the image data and a control signal for enabling the undershoot circuit 43 as to the unreversed pixel group (enable signal).

Based on the input control signal, the undershoot circuit 43 makes a display signal voltage which is supplied to the pixel group identified by the unreversed pixel identifying section 42 (i.e., unreversed pixel group) in the second vertical scan period smaller than the original largeness.

Here, a display signal voltage which is supplied to a reversed pixel group (a pixel group to which display signal voltages that have opposite polarities in the first vertical scan period and the second vertical scan period are supplied) in the second vertical scan period still has the original largeness.

Since the display control section 40 has the above-described configuration, the display control section 40 is capable of making the largeness of the display signal voltage supplied to the unreversed pixel group in the second vertical scan period different from the original largeness (smaller than the original largeness).

Note that the display control section 40 may make the largeness of the display signal voltage supplied to the unreversed pixel group in the second vertical scan period greater than the original largeness. For example, when the liquid crystal display device 100 is a normally-white mode liquid crystal display device where white display is provided in the absence of a voltage across the liquid crystal layer and an unintended luminance increase occurs immediately after switching of the polarity reversal mode, the largeness of the display signal voltage supplied to the unreversed pixel group in the second vertical scan period is made greater than the original largeness (i.e., the display signal voltage is overshot), whereby deterioration of the display quality can be suppressed.

Figure 10:
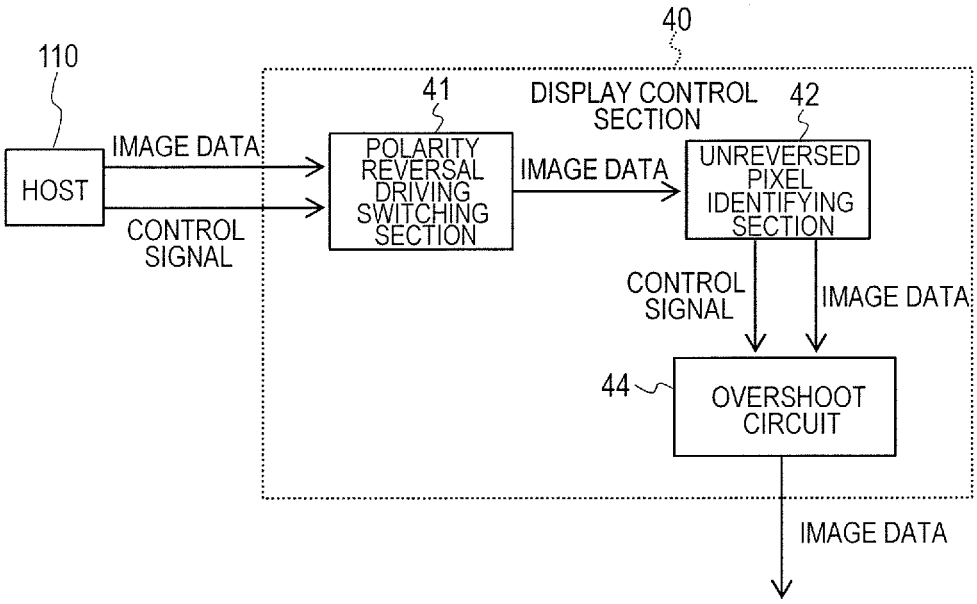
FIG. 10 A block diagram showing another specific configuration example of the display control section 40.

FIG. 10 shows another specific configuration example of the display control section 40. In the example illustrated in FIG. 10, the display control section 40 includes an overshoot circuit 44 in place of the undershoot circuit 43 provided in the example illustrated in FIG. 9. The overshoot circuit 44 makes the display signal voltage supplied in the second vertical scan period to the unreversed pixel group identified by the unreversed pixel identifying section 42 greater than the original largeness.

Since the display control section 40 has the configuration illustrated in FIG. 10, the display control section 40 is capable of making the largeness of the display signal voltage supplied to the unreversed pixel group in the second vertical scan period greater than the original largeness.

Although in the example described hereinabove the polarity reversal mode is switched according to a control signal from the external device (host 110), the polarity reversal mode may be autonomously (i.e., automatically) switched on the liquid crystal display device 100 side.

When switching of the polarity reversal mode is carried out in association with the intermittent driving which will be described later, it is only necessary to use, as the polarity reversal driving switching section 41, a component which can determine whether or not switching from the normal driving to the intermittent driving (or switching from the intermittent driving to the normal driving) has been done.

Although the amount of voltage adjustment by the display control section 40 is not particularly limited, it is preferred from the viewpoint of surely suppressing deterioration of the display quality that, for example, in the case of 256 grayscale levels, display signal voltages at almost all grayscale levels are shifted by one grayscale level. Note that the difference in transmittance corresponding to the difference of one grayscale level varies depending on the original grayscale level of the display signal voltage. In the case of 256 grayscale level representation and $\gamma=2.2$, the difference in transmittance corresponding to the difference of one grayscale level is 0.86% to 78.23%. Thus, it is preferred that the display control section 41 makes the largeness of the display signal voltage supplied to the unreversed pixel group in the second vertical scan period different from the original largeness by 0.86% or more in terms of transmittance.

Note that the minimum unit of the voltage adjustment amount is not necessarily one grayscale level. For example, even when the input/output circuit is an 8-bit circuit, processes are carried out on 10 bits inside the circuit, and the processes are again converted to 8 bits by a process such as FRC (frame rate control) or dithering, whereby voltage adjustment can be carried out with the minimum unit of 0.25 grayscale level.

As described above, according to an embodiment of the present invention, an unintended luminance variation immediately after switching of the polarity reversal mode and occurrence of flicker in display which is attributed to the unintended luminance variation can be prevented, and deterioration of the display quality is suppressed. Hereinafter, specific examples of switching of the polarity reversal mode (Embodiments 1 to 15) are described. The polarity reversal modes before and after switching in respective ones of Embodiments 1 to 15 are as shown in Table 1 below.

TABLE 1

| | | AFTER SWITCHING OF POLARITY REVERSAL MODE | | | | | |
|---|---|---|---|---|---|---|---|
| | | COLUMN REVERSAL | 1H DOT REVERSAL | 2H DOT REVERSAL | 4H DOT REVERSAL | SHIFTED 2H DOT REVERSAL | SHIFTED 4H DOT REVERSAL |
| BEFORE SWITCHING OF POLARITY REVERSAL MODE | COLUMN REVERSAL | — | EMBODIMENT 2 | EMBODIMENT 1 | EMBODIMENT 3 | EMBODIMENT 4 | EMBODIMENT 5 |
| | 1H DOT REVERSAL | EMBODIMENT 2 | — | EMBODIMENT 6 | EMBODIMENT 7 | EMBODIMENT 8 | EMBODIMENT 9 |
| | 2H DOT REVERSAL | EMBODIMENT 1 | EMBODIMENT 6 | — | EMBODIMENT 10 | EMBODIMENT 11 | EMBODIMENT 12 |
| | 4H DOT REVERSAL | EMBODIMENT 3 | EMBODIMENT 7 | EMBODIMENT 10 | — | EMBODIMENT 13 | EMBODIMENT 14 |
| | SHIFTED 2H DOT REVERSAL | EMBODIMENT 4 | EMBODIMENT 8 | EMBODIMENT 11 | EMBODIMENT 13 | — | EMBODIMENT 15 |
| | SHIFTED 4H DOT REVERSAL | EMBODIMENT 5 | EMBODIMENT 9 | EMBODIMENT 12 | EMBODIMENT 14 | EMBODIMENT 15 | — |

Embodiment 1

Figure 11:
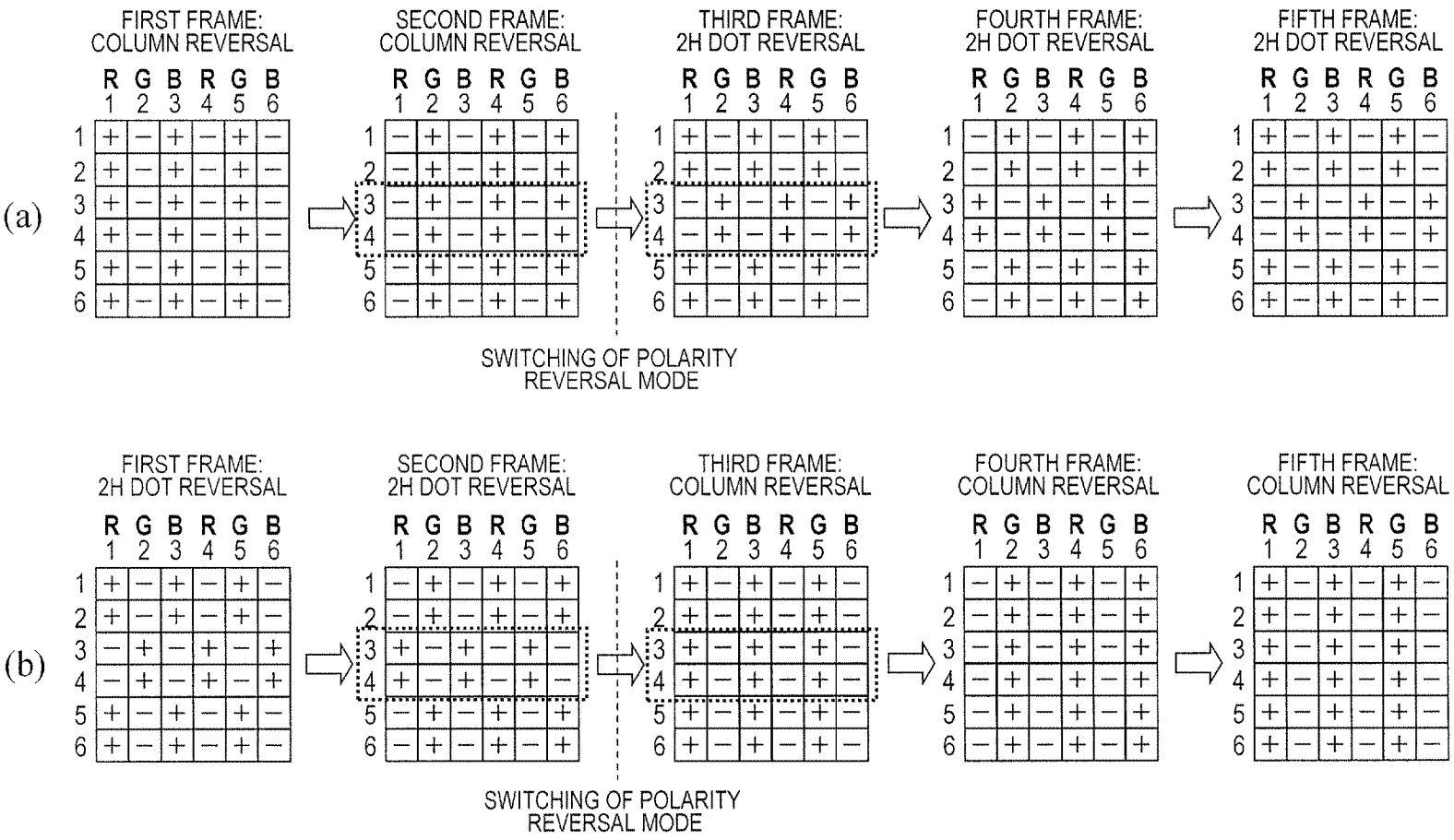
FIG. 11 (*a*) and (*b*) are diagrams for illustrating the polarity of display signal voltages supplied to respective pixels Px in switching from the column reversal mode to the 2H dot reversal mode and in switching from the 2H dot reversal mode to the column reversal mode (Embodiment 1).

In Embodiment 1, switching from the column reversal mode to the 2H dot reversal mode and switching from the 2H dot reversal mode to the column reversal mode are carried out. FIGS. 11(*a*) and 11(*b*) show the polarity of display signal voltages supplied to respective pixels Px in the cases of the former switching and the latter switching, respectively. In the examples illustrated in FIGS. 11(*a*) and 11(*b*), switching of the polarity reversal mode is carried out between the second frame and the third frame among five consecutive frames (first to fifth frames: each corresponding to one vertical scan period), and this switching is carried out such that the polarity of a display signal voltage supplied to a pixel at the intersection of the first row and the first column is reversed (the same applies to examples which will be described in the subsequent embodiments).

As seen from FIGS. 11(*a*) and 11(*b*), in the switching from the column reversal mode to the 2H dot reversal mode and in the switching from the 2H dot reversal mode to the column reversal mode, display signal voltages of the same polarity are supplied to pixels of the $(4n-1)^{th}$ row and the $4n^{th}$ row (n is an integer not less than 1) in frames (vertical scan periods) immediately preceding the switching and immediately succeeding the switching. Thus, by making the largeness of display signal voltages supplied to the pixels of the $(4n-1)^{th}$ row and the $4n^{th}$ row, which are unreversed pixels, in the third frame different from the original largeness, an unintended luminance variation and occurrence of flicker in display which is attributed to the unintended luminance variation can be prevented.

Figure 12:
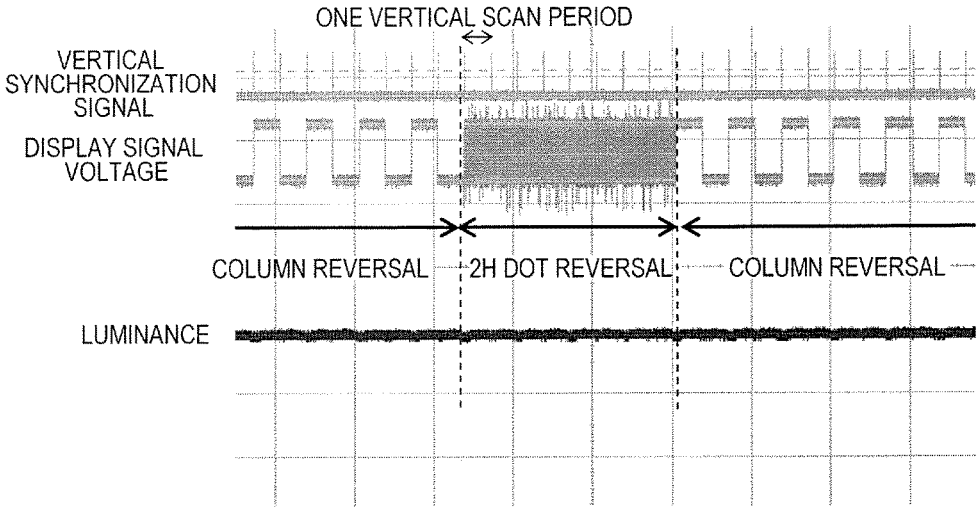
FIG. 12 A chart illustrating luminance variation of an unreversed pixel which occurs when the display control section 40 carries out a voltage adjustment on a display signal voltage supplied to the unreversed pixel in the case where the liquid crystal display device 100 is in a normally black mode.

FIG. 12 illustrates luminance variation of an unreversed pixel which occurs when the display control section 40 carries out a voltage adjustment on a display signal voltage supplied to the unreversed pixel in the case where the liquid crystal display device 100 is in a normally black mode. In the example illustrated in FIG. 12, the polarity reversal mode is once switched from the column reversal mode to the 2H dot reversal mode. After reversal driving is performed in the 2H dot reversal mode for a predetermined period (a period corresponding to 12 vertical scan periods), the polarity reversal mode is returned to the column reversal mode again. FIG. 12 also shows the vertical synchronization signal and the potential of a signal line (source bus line) 12 corresponding to that unreversed pixel (i.e., display signal voltage).

It can be seen from FIG. 12 that no unintended luminance increase occurs immediately after the switching from the column reversal mode to the 2H dot reversal mode and immediately after the switching from the 2H dot reversal mode to the column reversal mode.

Embodiment 2

Figure 13:
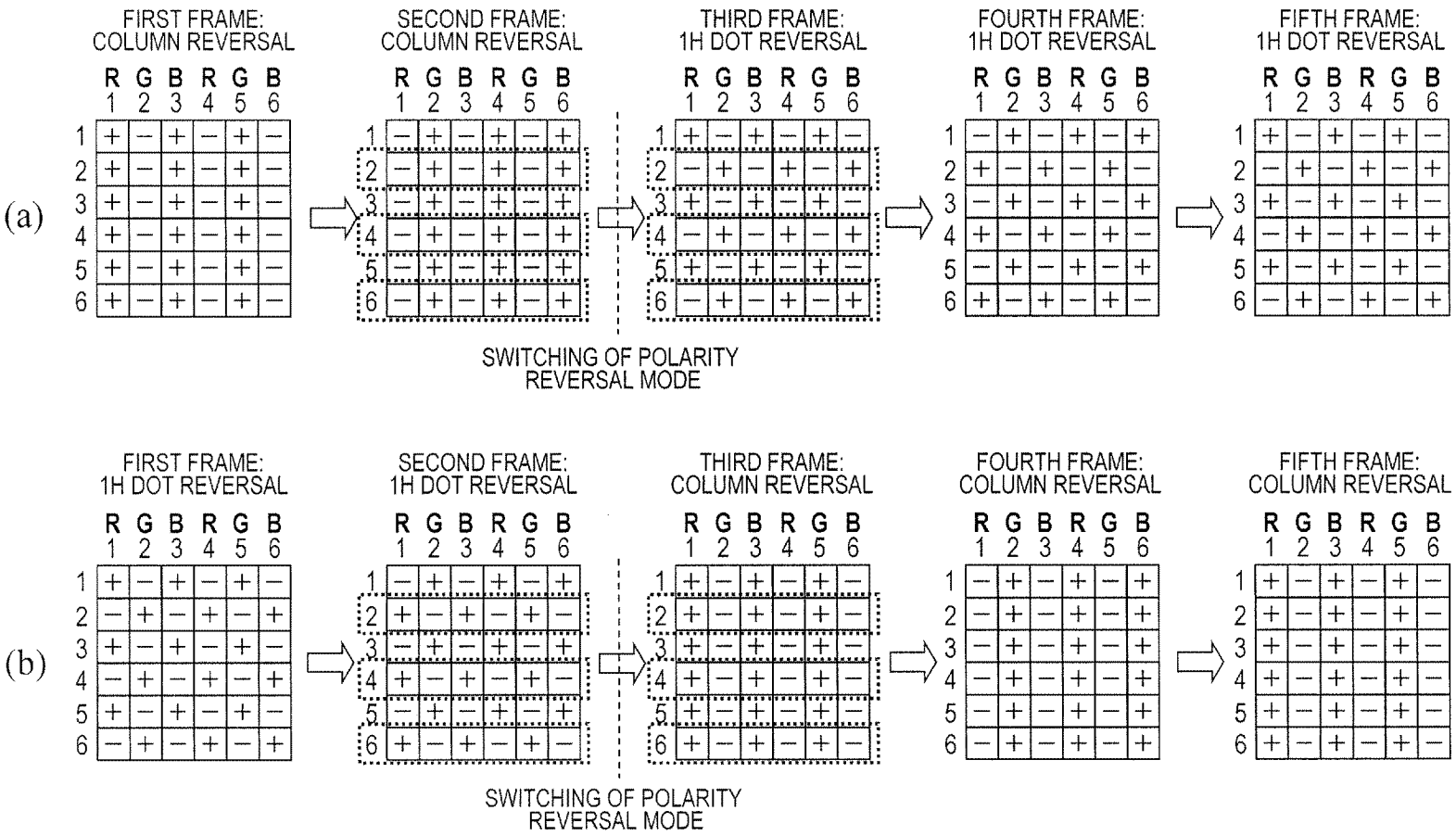
FIG. 13 (*a*) and (*b*) are diagrams for illustrating the polarity of display signal voltages supplied to respective pixels Px in switching from the column reversal mode to a 1H dot reversal mode and in switching from the 1H dot reversal mode to the column reversal mode (Embodiment 2).

In Embodiment 2, switching from the column reversal mode to the 1H dot reversal mode and switching from the 1H dot reversal mode to the column reversal mode are carried out. FIGS. 13(*a*) and 13(*b*) show the polarity of display signal voltages supplied to respective pixels Px in the cases of the former switching and the latter switching, respectively.

As seen from FIGS. 13(*a*) and 13(*b*), in the switching from the column reversal mode to the 1H dot reversal mode and in the switching from the 1H dot reversal mode to the column reversal mode, display signal voltages of the same polarity are supplied to pixels of the $2n^{th}$ row (n is an integer not less than 1) in frames (vertical scan periods) immediately preceding the switching and immediately succeeding the switching. Thus, by making the largeness of display signal voltages supplied to the pixels of the $2n^{th}$ row, which are unreversed pixels, in the third frame different from the original largeness, an unintended luminance variation and occurrence of flicker in display which is attributed to the unintended luminance variation can be prevented.

Embodiment 3

Figure 14:
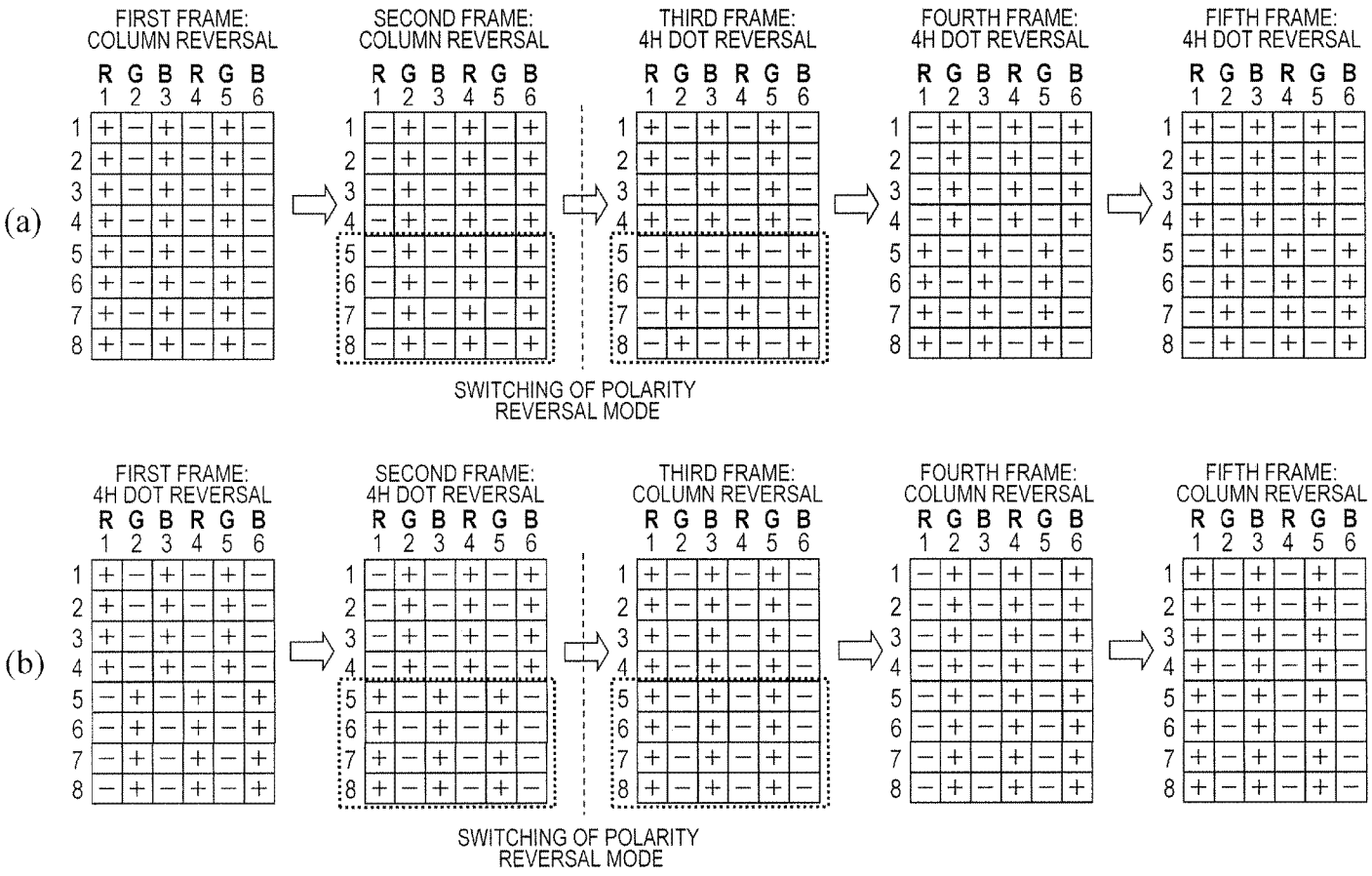
FIG. 14 (*a*) and (*b*) are diagrams for illustrating the polarity of display signal voltages supplied to respective pixels Px in switching from the column reversal mode to the 4H dot reversal mode and in switching from the 4H dot reversal mode to the column reversal mode (Embodiment 3).

In Embodiment 3, switching from the column reversal mode to the 4H dot reversal mode and switching from the 4H dot reversal mode to the column reversal mode are carried out. FIGS. 14(*a*) and 14(*b*) show the polarity of display signal voltages supplied to respective pixels Px in the cases of the former switching and the latter switching, respectively.

As seen from FIGS. 14(*a*) and 14(*b*), in the switching from the column reversal mode to the 4H dot reversal mode and in the switching from the 4H dot reversal mode to the column reversal mode, display signal voltages of the same polarity are supplied to pixels of the $(8n-3)^{th}$ row, the $(8n-2)^{th}$ row, the $(8n-1)^{th}$ row, and the $8n^{th}$ row (n is an integer not less than 1) in frames (vertical scan periods) immediately preceding the switching and immediately succeeding the switching. Thus, by making the largeness of display signal voltages supplied to the pixels of the $(8n-3)^{th}$ row, the $(8n-2)^{th}$ row, the $(8n-1)^{th}$ row, and the $8n^{th}$ row, which are unreversed pixels, in the third frame different from the original largeness, an unintended luminance variation and occurrence of flicker in display which is attributed to the unintended luminance variation can be prevented.

Embodiment 4

Figure 15:
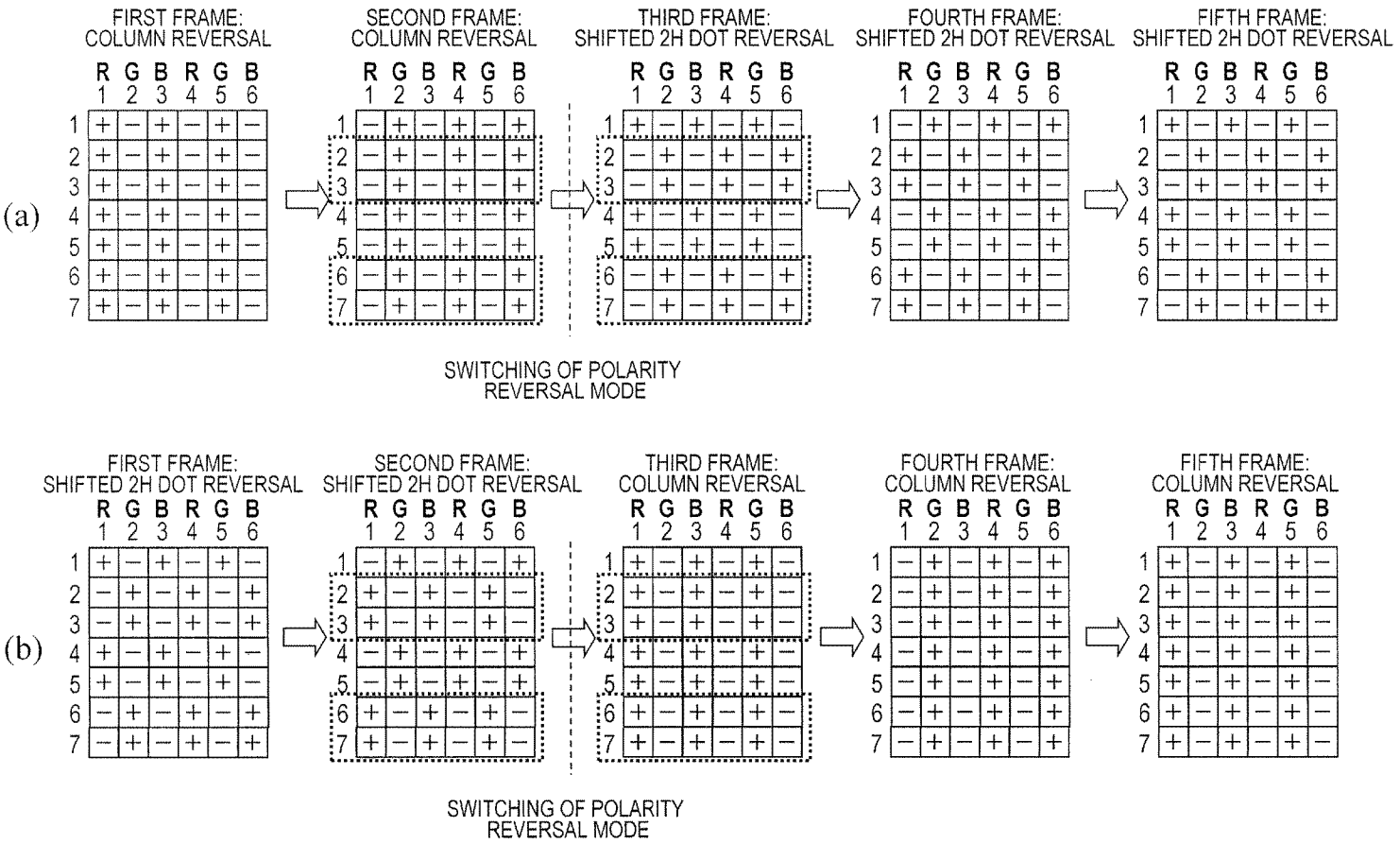
FIG. 15 (*a*) and (*b*) are diagrams for illustrating the polarity of display signal voltages supplied to respective pixels Px in switching from the column reversal mode to the shifted 2H dot reversal mode and in switching from the shifted 2H dot reversal mode to the column reversal mode (Embodiment 4).

In Embodiment 4, switching from the column reversal mode to the shifted 2H dot reversal mode and switching from the shifted 2H dot reversal mode to the column reversal mode are carried out. FIGS. 15(*a*) and 15(*b*) show the polarity of display signal voltages supplied to respective pixels Px in the cases of the former switching and the latter switching, respectively.

As seen from FIGS. 15(*a*) and 15(*b*), in the switching from the column reversal mode to the shifted 2H dot reversal mode and in the switching from the shifted 2H dot reversal mode to the column reversal mode, display signal voltages of the same polarity are supplied to pixels of the $(4n-2)^{th}$ row and the $(4n-1)^{th}$ row (n is an integer not less than 1) in frames (vertical scan periods) immediately preceding the switching and immediately succeeding the switching. Thus, by making the largeness of display signal voltages supplied to the pixels of the $(4n-2)^{th}$ row and the $(4n-1)^{th}$ row, which are unreversed pixels, in the third frame different from the original largeness, an unintended luminance variation and occurrence of flicker in display which is attributed to the unintended luminance variation can be prevented.

Embodiment 5

Figure 16:
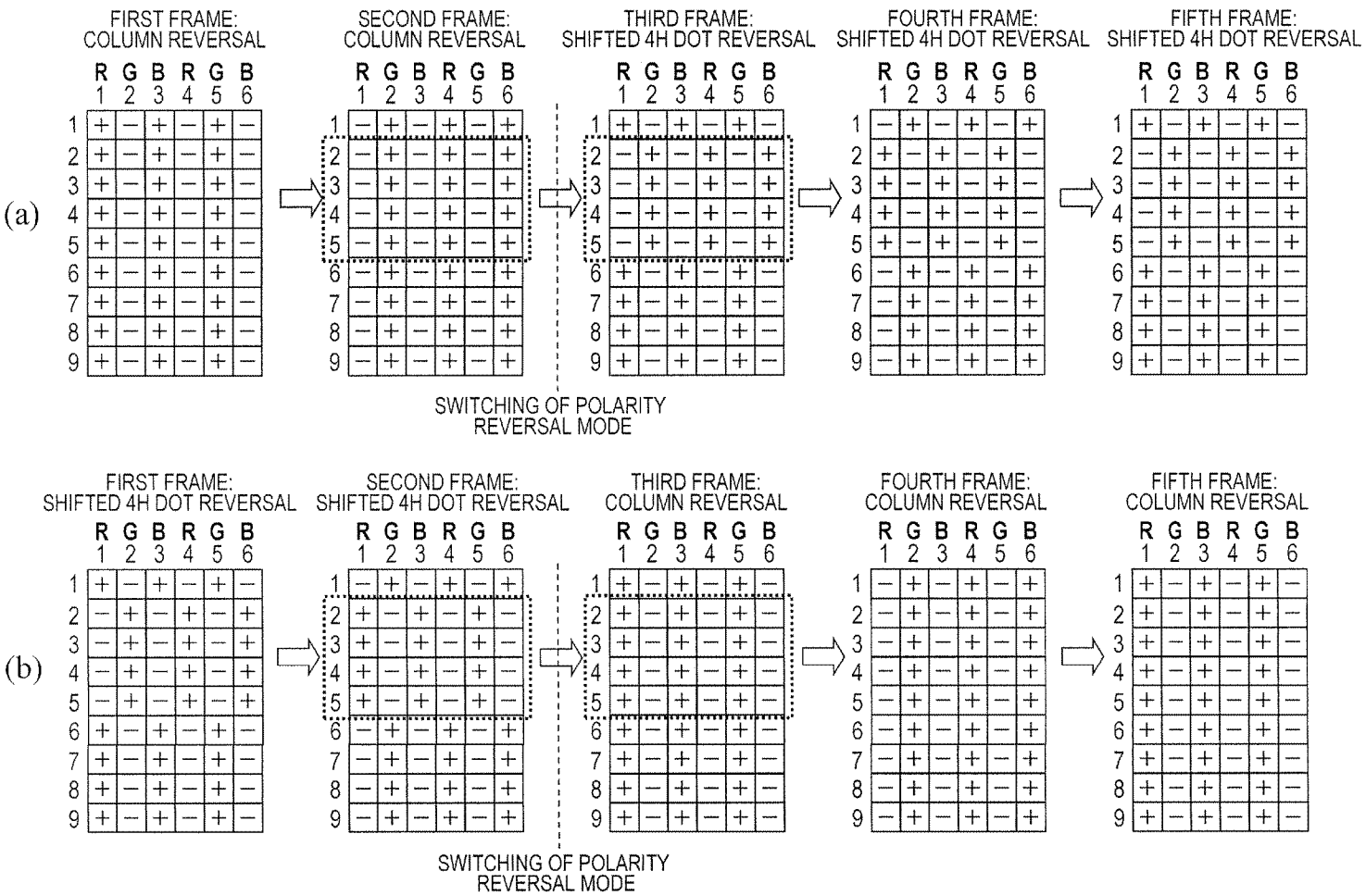
FIG. 16 (*a*) and (*b*) are diagrams for illustrating the polarity of display signal voltages supplied to respective pixels Px in switching from the column reversal mode to the shifted 4H dot reversal mode and in switching from the shifted 4H dot reversal mode to the column reversal mode (Embodiment 5).

In Embodiment 5, switching from the column reversal mode to the shifted 4H dot reversal mode and switching from the shifted 4H dot reversal mode to the column reversal mode are carried out. FIGS. 16(*a*) and 16(*b*) show the polarity of display signal voltages supplied to respective pixels Px in the cases of the former switching and the latter switching, respectively.

As seen from FIGS. 16(*a*) and 16(*b*), in the switching from the column reversal mode to the shifted 4H dot reversal mode and in the switching from the shifted 4H dot reversal mode to the column reversal mode, display signal voltages of the same polarity are supplied to pixels of the $(8n-6)^{th}$ row, the $(8n-5)^{th}$ row, the $(8n-4)^{th}$ row, and the $(8n-3)^{th}$ row (n is an integer not less than 1) in frames (vertical scan periods) immediately preceding the switching and immediately succeeding the switching. Thus, by making the largeness of display signal voltages supplied to the pixels of the $(8n-6)^{th}$ row, the $(8n-5)^{th}$ row, the $(8n-4)^{th}$ row, and the $(8n-3)^{th}$ row, which are unreversed pixels, in the third frame different from the original largeness, an unintended luminance variation and occurrence of flicker in display which is attributed to the unintended luminance variation can be prevented.

Embodiment 6

Figure 17:
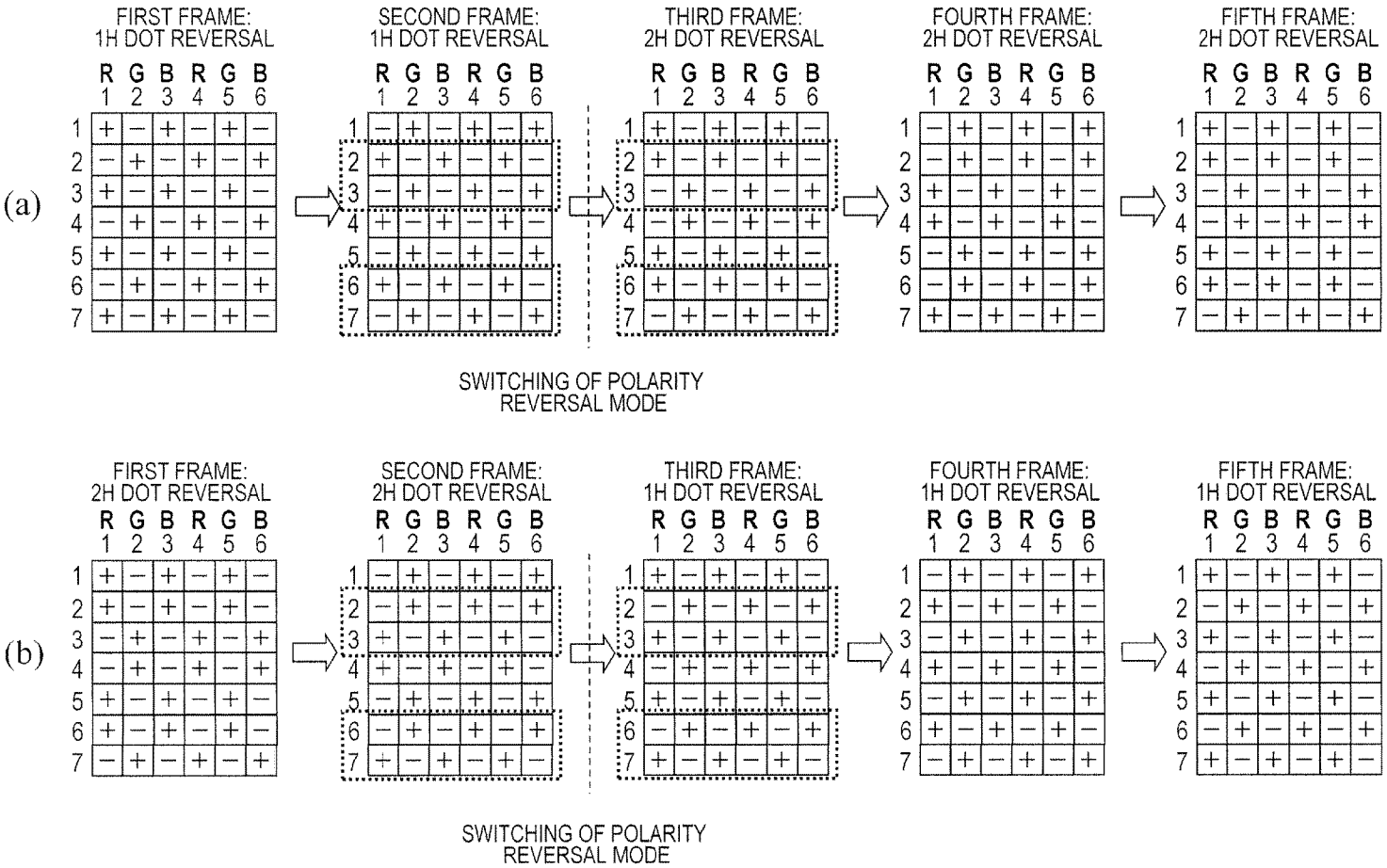
FIG. 17 (*a*) and (*b*) are diagrams for illustrating the polarity of display signal voltages supplied to respective pixels Px in switching from the 1H dot reversal mode to the 2H dot reversal mode and in switching from the 2H dot reversal mode to the 1H dot reversal mode (Embodiment 6).

In Embodiment 6, switching from the 1H dot reversal mode to the 2H dot reversal mode and switching from the 2H dot reversal mode to the 1H dot reversal mode are carried out. FIGS. 17(*a*) and 17(*b*) show the polarity of display signal voltages supplied to respective pixels Px in the cases of the former switching and the latter switching, respectively.

As seen from FIGS. 17(*a*) and 17(*b*), in the switching from the 1H dot reversal mode to the 2H dot reversal mode and in the switching from the 2H dot reversal mode to the 1H dot reversal mode, display signal voltages of the same polarity are supplied to pixels of the $(4n-2)^{th}$ row and the $(4n-1)^{th}$ row (n is an integer not less than 1) in frames (vertical scan periods) immediately preceding the switching and immediately succeeding the switching. Thus, by making the largeness of display signal voltages supplied to the pixels of the $(4n-2)^{th}$ row and the $(4n-1)^{th}$ row, which are unreversed pixels, in the third frame different from the original largeness, an unintended luminance variation and occurrence of flicker in display which is attributed to the unintended luminance variation can be prevented.

Embodiment 7

Figure 18:
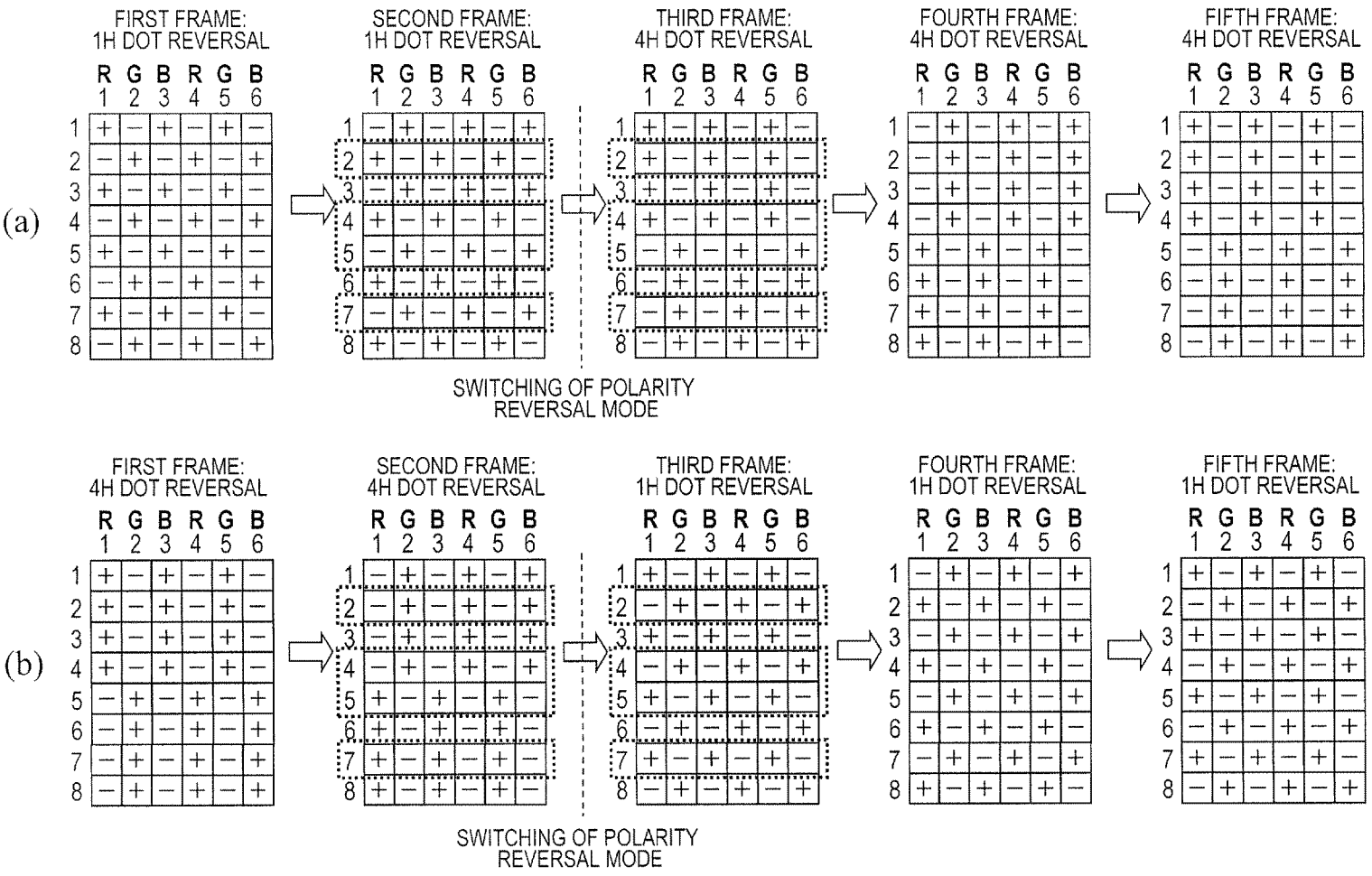
FIG. 18 (*a*) and (*b*) are diagrams for illustrating the polarity of display signal voltages supplied to respective pixels Px in switching from the 1H dot reversal mode to the 4H dot reversal mode and in switching from the 4H dot reversal mode to the 1H dot reversal mode (Embodiment 7).

In Embodiment 7, switching from the 1H dot reversal mode to the 4H dot reversal mode and switching from the 4H dot reversal mode to the 1H dot reversal mode are carried out. FIGS. 18(*a*) and 18(*b*) show the polarity of display signal voltages supplied to respective pixels Px in the cases of the former switching and the latter switching, respectively.

As seen from FIGS. 18(*a*) and 18(*b*), in the switching from the 1H dot reversal mode to the 4H dot reversal mode and in the switching from the 4H dot reversal mode to the 1H dot reversal mode, display signal voltages of the same polarity are supplied to pixels of the $(8n-6)^{th}$ row, the $(8n-4)^{th}$ row, the $(8n-3)^{th}$ row, and the $(8n-1)^{th}$ row (n is an integer not less than 1) in frames (vertical scan periods) immediately preceding the switching and immediately succeeding the switching. Thus, by making the largeness of display signal voltages supplied to the pixels of the $(8n-6)^{th}$ row, the $(8n-4)^{th}$ row, the $(8n-3)^{th}$ row, and the $(8n-1)^{th}$ row, which are unreversed pixels, in the third frame different from the original largeness, an unintended luminance variation and occurrence of flicker in display which is attributed to the unintended luminance variation can be prevented.

Embodiment 8

Figure 19:
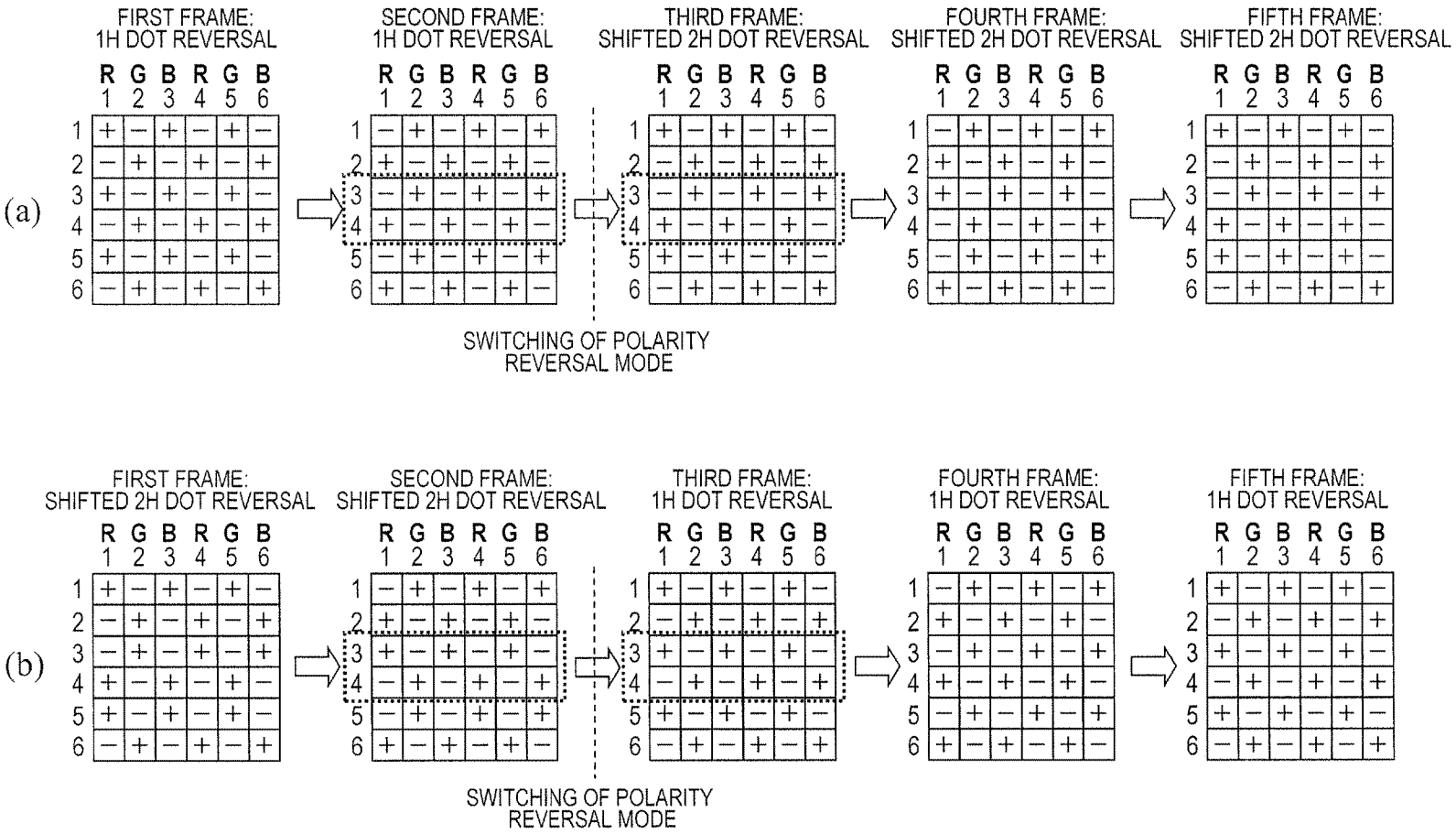
FIG. 19 (*a*) and (*b*) are diagrams for illustrating the polarity of display signal voltages supplied to respective pixels Px in switching from the 1H dot reversal mode to the shifted 2H dot reversal mode and in switching from the shifted 2H dot reversal mode to the 1H dot reversal mode (Embodiment 8).

In Embodiment 8, switching from the 1H dot reversal mode to the shifted 2H dot reversal mode and switching from the shifted 2H dot reversal mode to the 1H dot reversal mode are carried out. FIGS. 19(*a*) and 19(*b*) show the polarity of display signal voltages supplied to respective pixels Px in the cases of the former switching and the latter switching, respectively.

As seen from FIGS. 19(*a*) and 19(*b*), in the switching from the 1H dot reversal mode to the shifted 2H dot reversal mode and in the switching from the shifted 2H dot reversal mode to the 1H dot reversal mode, display signal voltages of the same polarity are supplied to pixels of the $(4n-1)^{th}$ row and the $4n^{th}$ row (n is an integer not less than 1) in frames (vertical scan periods) immediately preceding the switching and immediately succeeding the switching. Thus, by making the largeness of display signal voltages supplied to the pixels of the $(4n-1)^{th}$ row and the $4n^{th}$ row, which are unreversed pixels, in the third frame different from the original largeness, an unintended luminance variation and occurrence of flicker in display which is attributed to the unintended luminance variation can be prevented.

Embodiment 9

Figure 20:
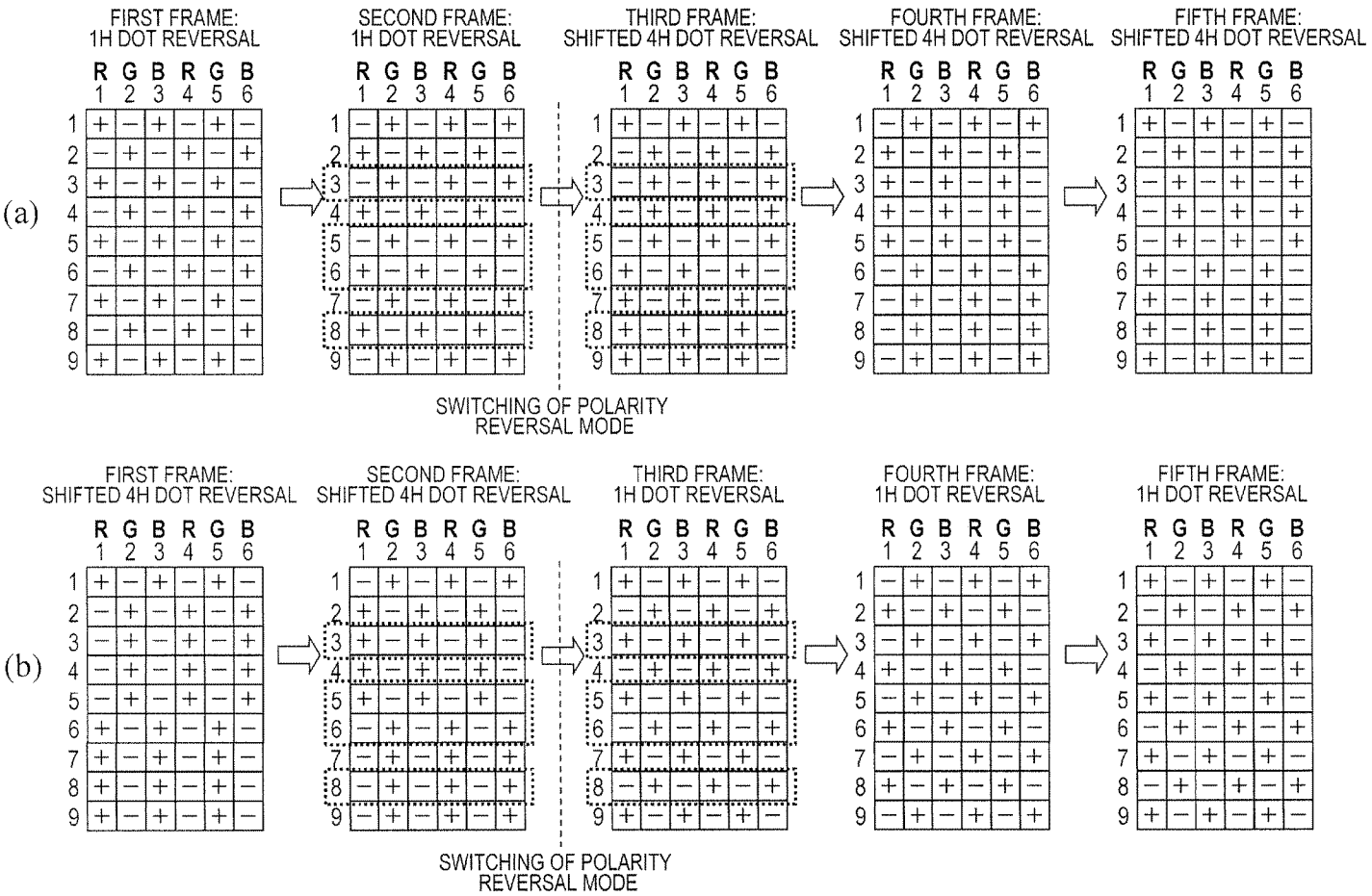
FIG. 20 (*a*) and (*b*) are diagrams for illustrating the polarity of display signal voltages supplied to respective pixels Px in switching from the 1H dot reversal mode to the shifted 4H dot reversal mode and in switching from the shifted 4H dot reversal mode to the 1H dot reversal mode (Embodiment 9).

In Embodiment 9, switching from the 1H dot reversal mode to the shifted 4H dot reversal mode and switching from the shifted 4H dot reversal mode to the 1H dot reversal mode are carried out. FIGS. 20(*a*) and 20(*b*) show the polarity of display signal voltages supplied to respective pixels Px in the cases of the former switching and the latter switching, respectively.

As seen from FIGS. 20(*a*) and 20(*b*), in the switching from the 1H dot reversal mode to the shifted 4H dot reversal mode and in the switching from the shifted 4H dot reversal mode to the 1H dot reversal mode, display signal voltages of the same polarity are supplied to pixels of the $(8n-5)^{th}$ row, the $(8n-3)^{th}$ row, the $(8n-2)^{th}$ row, and the $8n^{th}$ row (n is an integer not less than 1) in frames (vertical scan periods) immediately preceding the switching and immediately succeeding the switching. Thus, by making the largeness of display signal voltages supplied to the pixels of the $(8n-5)^{th}$ row, the $(8n-3)^{th}$ row, the $(8n-2)^{th}$ row, and the $8n^{th}$ row, which are unreversed pixels, in the third frame different from the original largeness, an unintended luminance variation and occurrence of flicker in display which is attributed to the unintended luminance variation can be prevented.

Embodiment 10

Figure 21:
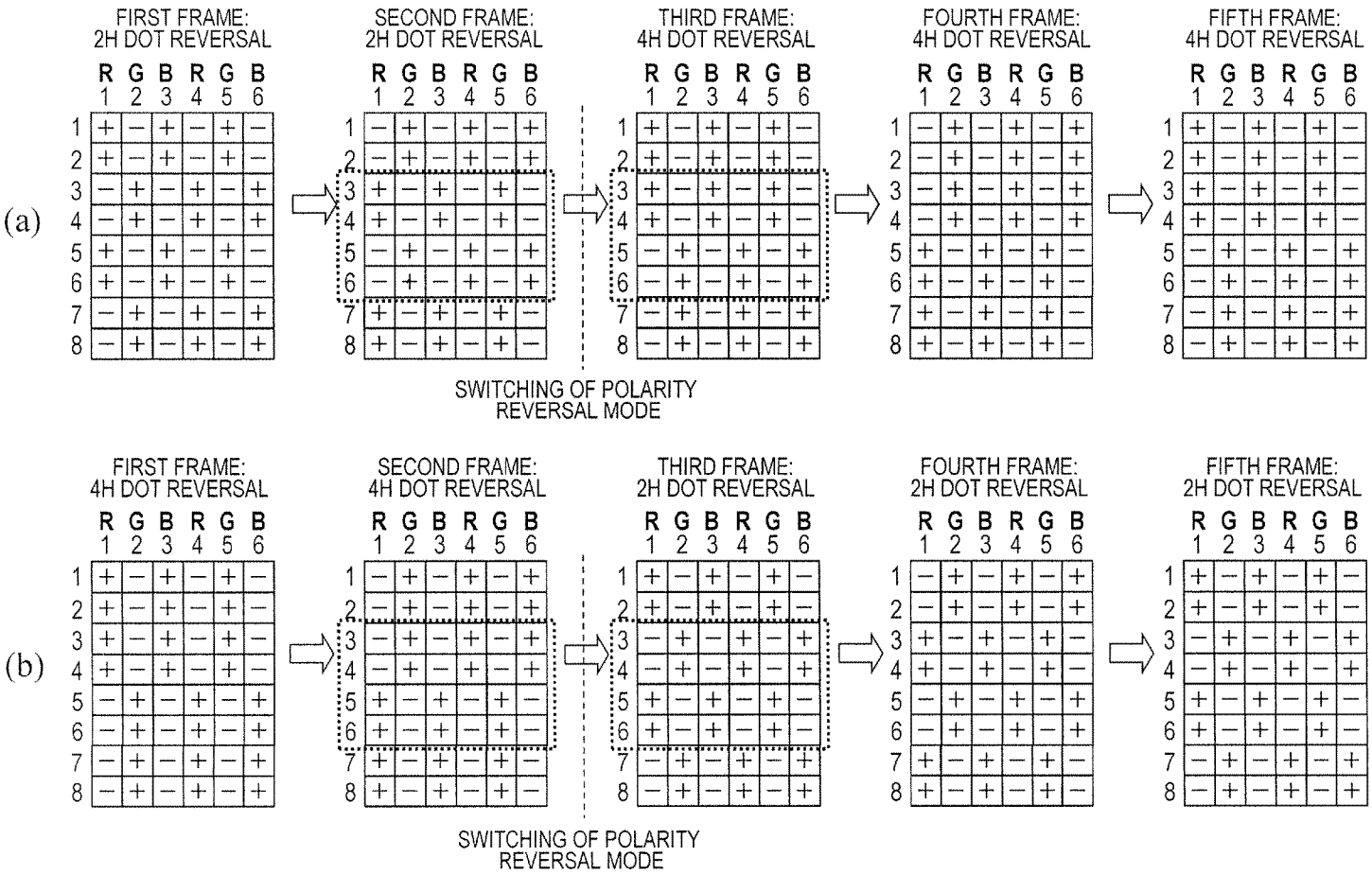
FIG. 21 (*a*) and (*b*) are diagrams for illustrating the polarity of display signal voltages supplied to respective pixels Px in switching from the 2H dot reversal mode to the 4H dot reversal mode and in switching from the 4H dot reversal mode to the 2H dot reversal mode (Embodiment 10).

In Embodiment 10, switching from the 2H dot reversal mode to the 4H dot reversal mode and switching from the 4H dot reversal mode to the 2H dot reversal mode are carried out. FIGS. 21(*a*) and 21(*b*) show the polarity of display signal voltages supplied to respective pixels Px in the cases of the former switching and the latter switching, respectively.

As seen from FIGS. 21(*a*) and 21(*b*), in the switching from the 2H dot reversal mode to the 4H dot reversal mode and in the switching from the 4H dot reversal mode to the 2H dot reversal mode, display signal voltages of the same polarity are supplied to pixels of the $(8n-5)^{th}$ row, the $(8n-4)^{th}$ row, the $(8n-3)^{th}$ row, and the $(8n-2)^{th}$ row (n is an integer not less than 1) in frames (vertical scan periods) immediately preceding the switching and immediately succeeding the switching. Thus, by making the largeness of display signal voltages supplied to the pixels of the $(8n-5)^{th}$ row, the $(8n-4)^{th}$ row, the $(8n-3)^{th}$ row, and the $(8n-2)^{th}$ row, which are unreversed pixels, in the third frame different from the original largeness, an unintended luminance variation and occurrence of flicker in display which is attributed to the unintended luminance variation can be prevented.

Embodiment 11

Figure 22:
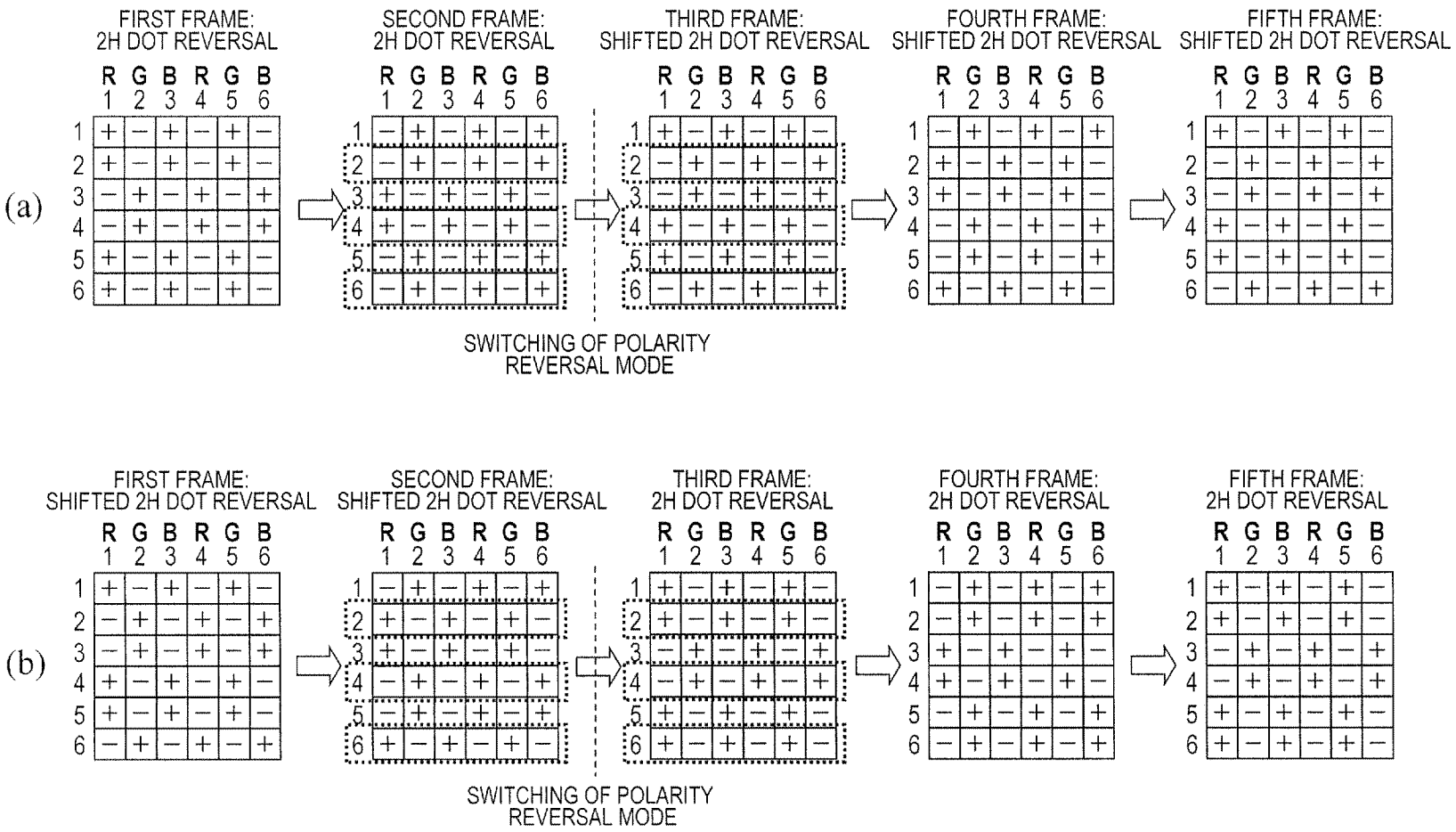
FIG. 22 (*a*) and (*b*) are diagrams for illustrating the polarity of display signal voltages supplied to respective pixels Px in switching from the 2H dot reversal mode to the shifted 2H dot reversal mode and in switching from the shifted 2H dot reversal mode to the 2H dot reversal mode (Embodiment 11).

In Embodiment 11, switching from the 2H dot reversal mode to the shifted 2H dot reversal mode and switching from the shifted 2H dot reversal mode to the 2H dot reversal mode are carried out. FIGS. 22(*a*) and 22(*b*) show the polarity of display signal voltages supplied to respective pixels Px in the cases of the former switching and the latter switching, respectively.

As seen from FIGS. 22(*a*) and 22(*b*), in the switching from the 2H dot reversal mode to the shifted 2H dot reversal mode and in the switching from the shifted 2H dot reversal mode to the 2H dot reversal mode, display signal voltages of the same polarity are supplied to pixels of the $2n^{th}$ row (n is an integer not less than 1) in frames (vertical scan periods) immediately preceding the switching and immediately succeeding the switching. Thus, by making the largeness of display signal voltages supplied to the pixels of the $2n^{th}$ row, which are unreversed pixels, in the third frame different from the original largeness, an unintended luminance variation and occurrence of flicker in display which is attributed to the unintended luminance variation can be prevented.

Embodiment 12

Figure 23:
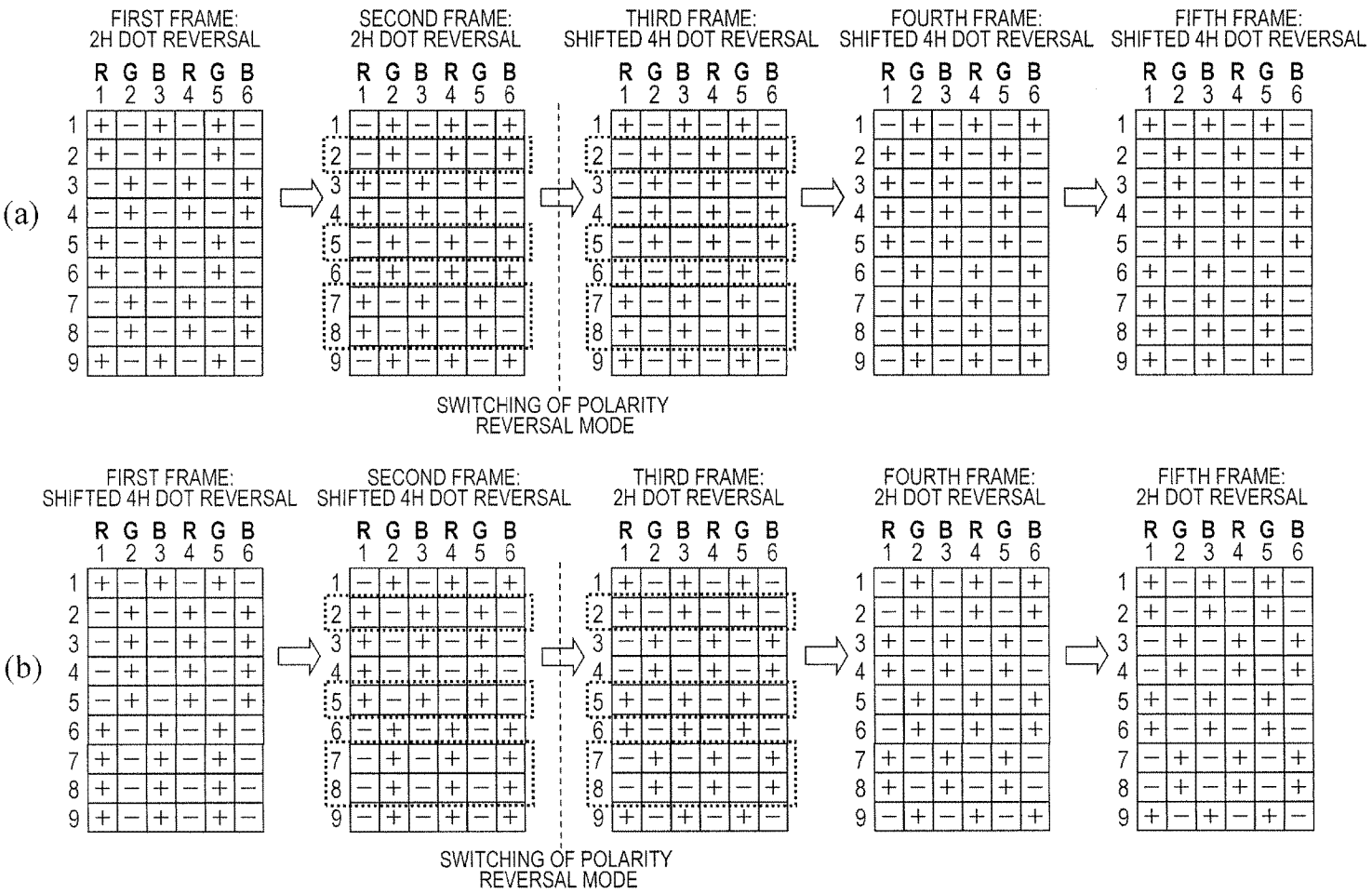
FIG. 23 (*a*) and (*b*) are diagrams for illustrating the polarity of display signal voltages supplied to respective pixels Px in switching from the 2H dot reversal mode to the shifted 4H dot reversal mode and in switching from the shifted 4H dot reversal mode to the 2H dot reversal mode (Embodiment 12).

In Embodiment 12, switching from the 2H dot reversal mode to the shifted 4H dot reversal mode and switching from the shifted 4H dot reversal mode to the 2H dot reversal mode are carried out. FIGS. 23(*a*) and 23(*b*) show the polarity of display signal voltages supplied to respective pixels Px in the cases of the former switching and the latter switching, respectively.

As seen from FIGS. 23(*a*) and 23(*b*), in the switching from the 2H dot reversal mode to the shifted 4H dot reversal mode and in the switching from the shifted 4H dot reversal mode to the 2H dot reversal mode, display signal voltages of the same polarity are supplied to pixels of the $(8n-6)^{th}$ row, the $(8n-3)^{th}$ row, the $(8n-1)^{th}$ row, and the $8n^{th}$ row (n is an integer not less than 1) in frames (vertical scan periods) immediately preceding the switching and immediately succeeding the switching. Thus, by making the largeness of display signal voltages supplied to the pixels of the $(8n-6)^{th}$ row, the $(8n-3)^{th}$ row, the $(8n-1)^{th}$ row, and the $8n^{th}$ row, which are unreversed pixels, in the third frame different from the original largeness, an unintended luminance variation and occurrence of flicker in display which is attributed to the unintended luminance variation can be prevented.

Embodiment 13

Figure 24:
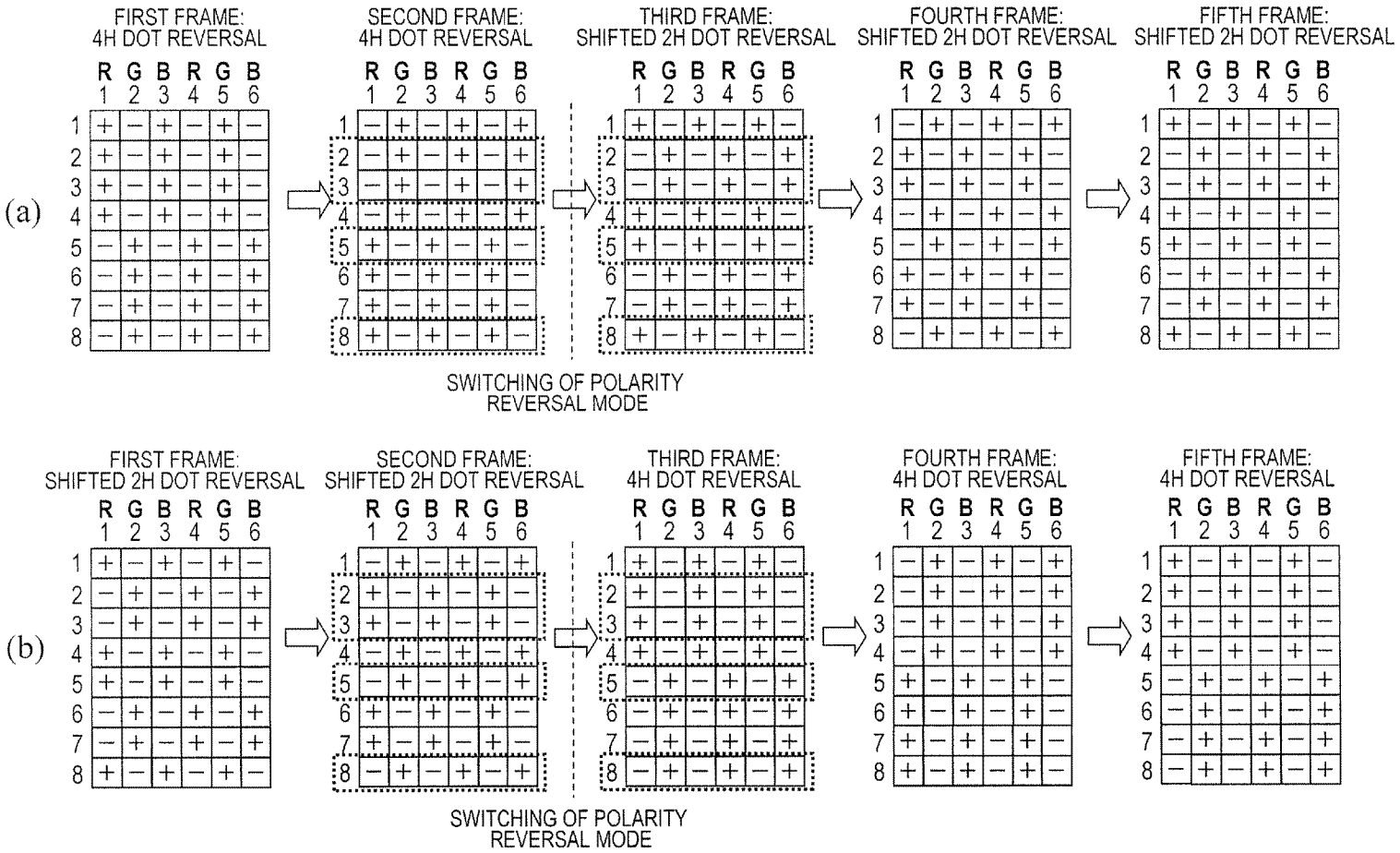
FIG. 24 (*a*) and (*b*) are diagrams for illustrating the polarity of display signal voltages supplied to respective pixels Px in switching from the 4H dot reversal mode to the shifted 2H dot reversal mode and in switching from the shifted 2H dot reversal mode to the 4H dot reversal mode (Embodiment 13).

In Embodiment 13, switching from the 4H dot reversal mode to the shifted 2H dot reversal mode and switching from the shifted 2H dot reversal mode to the 4H dot reversal mode are carried out. FIGS. 24(*a*) and 24(*b*) show the polarity of display signal voltages supplied to respective pixels Px in the cases of the former switching and the latter switching, respectively.

As seen from FIGS. 24(*a*) and 24(*b*), in the switching from the 4H dot reversal mode to the shifted 2H dot reversal mode and in the switching from the shifted 2H dot reversal mode to the 4H dot reversal mode, display signal voltages of the same polarity are supplied to pixels of the $(8n-6)^{th}$ row, the $(8n-5)^{th}$ row, the $(8n-3)^{th}$ row, and the $8n^{th}$ row (n is an integer not less than 1) in frames (vertical scan periods) immediately preceding the switching and immediately succeeding the switching. Thus, by making the largeness of display signal voltages supplied to the pixels of the $(8n-6)^{th}$ row, the $(8n-5)^{th}$ row, the $(8n-3)^{th}$ row, and the $8n^{th}$ row, which are unreversed pixels, in the third frame different from the original largeness, an unintended luminance variation and occurrence of flicker in display which is attributed to the unintended luminance variation can be prevented.

Embodiment 14

Figure 25:
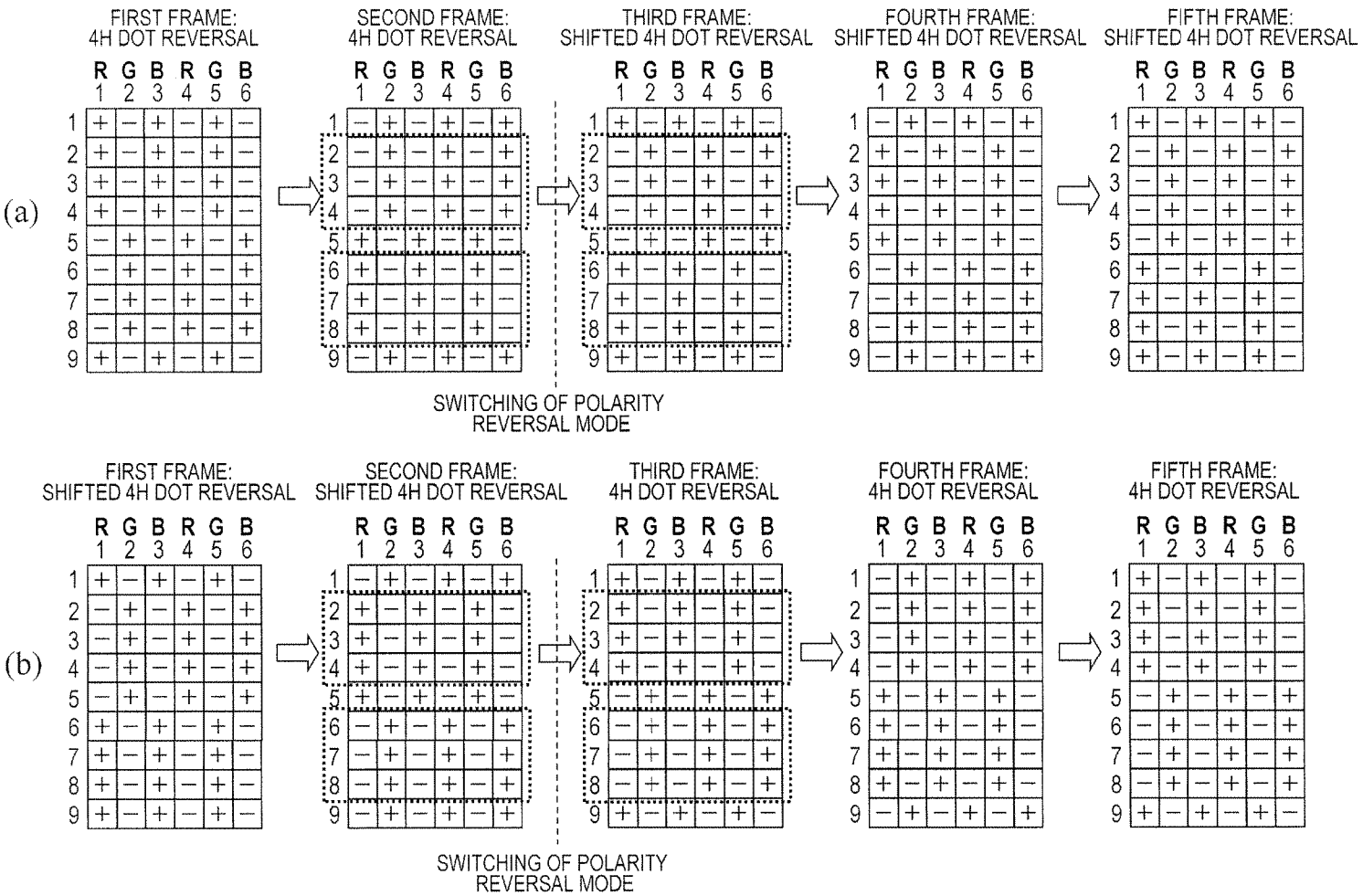
FIG. 25 (*a*) and (*b*) are diagrams for illustrating the polarity of display signal voltages supplied to respective pixels Px in switching from the 4H dot reversal mode to the shifted 4H dot reversal mode and in switching from the shifted 4H dot reversal mode to the 4H dot reversal mode (Embodiment 14).

In Embodiment 14, switching from the 4H dot reversal mode to the shifted 4H dot reversal mode and switching from the shifted 4H dot reversal mode to the 4H dot reversal mode are carried out. FIGS. 25(*a*) and 25(*b*) show the polarity of display signal voltages supplied to respective pixels Px in the cases of the former switching and the latter switching, respectively.

As seen from FIGS. 25(*a*) and 25(*b*), in the switching from the 4H dot reversal mode to the shifted 4H dot reversal mode and in the switching from the shifted 4H dot reversal mode to the 4H dot reversal mode, display signal voltages of the same polarity are supplied to pixels of the $(4n-2)^{th}$ row, the $(4n-1)^{th}$ row, and the $4n^{th}$ row (n is an integer not less than 1) in frames (vertical scan periods) immediately preceding the switching and immediately succeeding the switching. Thus, by making the largeness of display signal voltages supplied to the pixels of the $(4n-2)^{th}$ row, the $(4n-1)^{th}$ row, and the $4n^{th}$ row, which are unreversed pixels, in the third frame different from the original largeness, an unintended luminance variation and occurrence of flicker in display which is attributed to the unintended luminance variation can be prevented.

Embodiment 15

Figure 26:
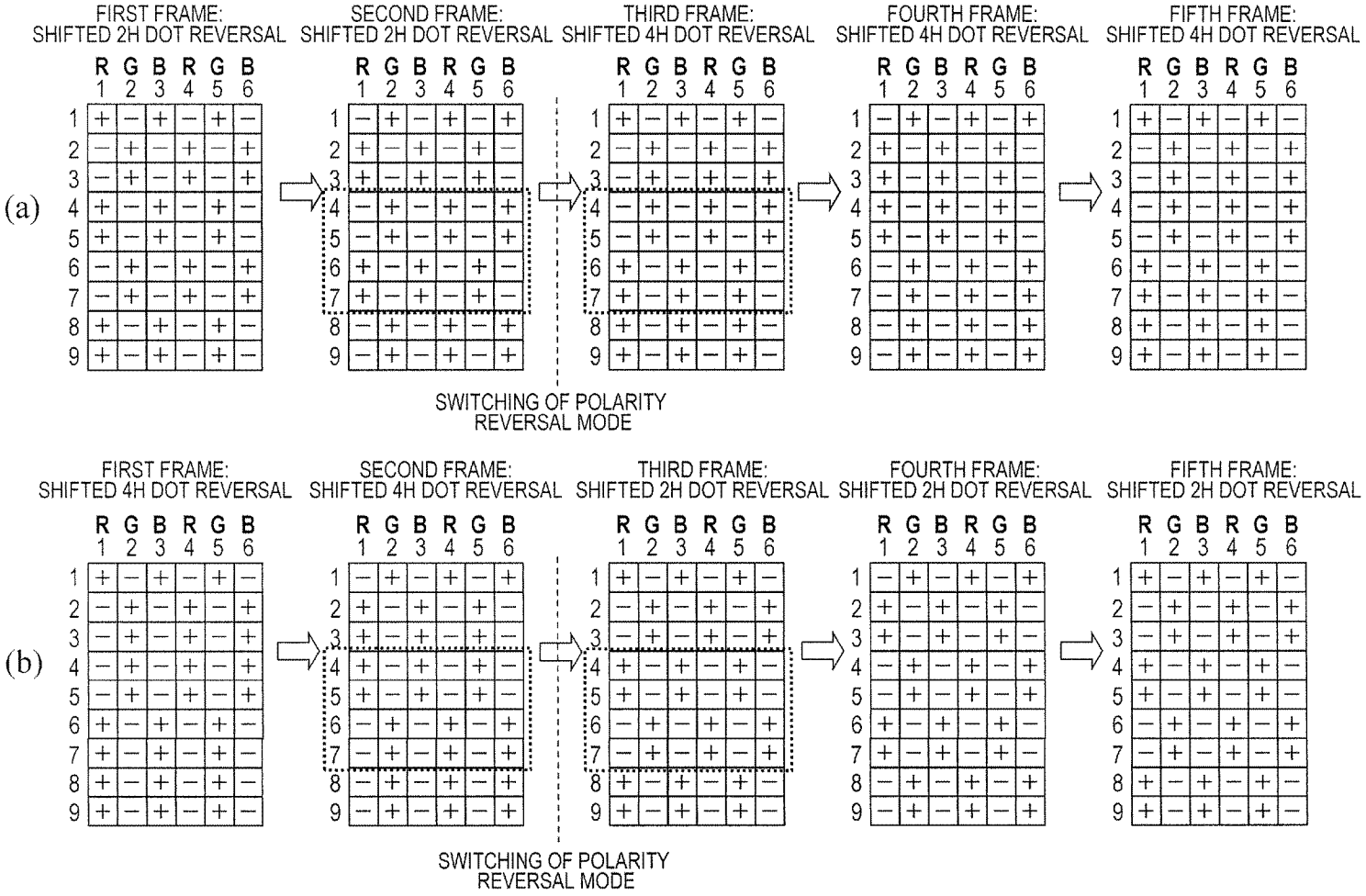
FIG. 26 (*a*) and (*b*) are diagrams for illustrating the polarity of display signal voltages supplied to respective pixels Px in switching from the shifted 2H dot reversal mode to the shifted 4H dot reversal mode and in switching from the shifted 4H dot reversal mode to the shifted 2H dot reversal mode (Embodiment 15).

In Embodiment 15, switching from the shifted 2H dot reversal mode to the shifted 4H dot reversal mode and switching from the shifted 4H dot reversal mode to the shifted 2H dot reversal mode are carried out. FIGS. 26(*a*) and 26(*b*) show the polarity of display signal voltages supplied to respective pixels Px in the cases of the former switching and the latter switching, respectively.

As seen from FIGS. 26(*a*) and 26(*b*), in the switching from the shifted 2H dot reversal mode to the shifted 4H dot reversal mode and in the switching from the shifted 4H dot reversal mode to the shifted 2H dot reversal mode, display signal voltages of the same polarity are supplied to pixels of the $(8n-4)^{th}$ row, the $(8n-3)^{th}$ row, the $(8n-2)^{th}$ row, and the $(8n-1)^{th}$ row (n is an integer not less than 1) in frames (vertical scan periods) immediately preceding the switching and immediately succeeding the switching. Thus, by making the largeness of display signal voltages supplied to the pixels of the $(8n-4)^{th}$ row, the $(8n-3)^{th}$ row, the $(8n-2)^{th}$ row, and the $(8n-1)^{th}$ row, which are unreversed pixels, in the third frame different from the original largeness, an unintended luminance variation and occurrence of flicker in display which is attributed to the unintended luminance variation can be prevented.

Other Embodiments

In the foregoing description, the display control section 40 carries out a voltage adjustment only on unreversed pixels in a vertical scan period immediately succeeding the switching of the polarity reversal mode (second vertical scan period). However, the display control section 40 may carry out a voltage adjustment on all the pixels (i.e., both unreversed pixel group and reversed pixel group) in the second vertical scan period.

For example, a voltage adjustment for improving the response speed (a voltage adjustment for so-called overshoot driving or undershoot driving) may be carried out on all the pixels, while a voltage adjustment for further suppressing an unintended luminance variation may be carried out on the unreversed pixel group. In this case, the display control section 40 only needs to be capable of making a voltage adjustment amount for display signal voltages supplied in the second vertical scan period to the unreversed pixel group (a pixel group to which display signal voltages that have the same polarity in both the first vertical scan period and the second vertical scan period are supplied) and a voltage adjustment amount for display signal voltages supplied in the second vertical scan period to the reversed pixel group (a pixel group to which display signal voltages that have opposite polarities in the first vertical scan period and the second vertical scan period are supplied) different from each other (when display signal voltages of the same grayscale level are compared). The voltage adjustment amount for the display signal voltages supplied to the reversed pixel group only includes an adjustment amount for improving the response speed. Meanwhile, the voltage adjustment amount for the display signal voltages supplied to the unreversed pixel group is the total of the adjustment amount for improving the response speed and the adjustment amount for suppressing the unintended luminance variation.

(Intermittent Driving)

The liquid crystal display device 100 according to an embodiment of the present invention may be a liquid crystal display device which is capable of intermittent driving. In displaying of a still image or the like, the power consumption can be greatly reduced by carrying out intermittent driving (where image data is rewritten at the frequency of, for example, one to several hertz (Hz)).

In a common 60 Hz-driven liquid crystal display device, a display signal voltage is supplied every vertical scan period (for about 1/60 second). That is, in 60-Hz driving, a display signal is applied to a pixel 60 times in one second.

On the other hand, in the intermittent driving, a display signal voltage is supplied to a pixel in a predetermined vertical scan period, and in a single or plurality of subsequent vertical scan periods, the display signal voltage is not supplied. That is, in the intermittent driving, a signal supply period where display signal voltages are supplied to respective pixels Px and a pause period where display signal voltages are not supplied to respective pixels Px are provided in one frame.

For example, intermittent driving with the driving frequency of 1 Hz may be carried out such that a display signal voltage is supplied to a pixel in one vertical scan period (one vertical scan period of 60-Hz driving: 1/60 second), and thereafter, the display signal is not supplied to the pixel in 59 vertical scan periods (59/60 second) succeeding that vertical scan period. Note that, in the intermittent driving, a voltage may be supplied over a plurality of vertical scan periods in order to apply a desired display signal voltage to a pixel. For example, intermittent driving may be carried out such that, in the first three vertical scan periods, a display signal voltage is supplied to a pixel, and 57 succeeding vertical scan periods are pause periods.

As seen from the foregoing description, in the specification of the present application, a period assigned for supplying a certain display signal to a pixel is referred to as one frame. In 1-Hz intermittent driving, one frame includes 60 vertical scan periods. Within these periods, signal supply periods and pause periods are appropriately set. Note that in the above-described 60-Hz driving, one frame corresponds to one vertical scan period. Note that, as seen from the foregoing description, in this specification, the term "driving frequency" corresponds to the inverse of one frame period (second). For example, when the driving frequency is set to 10 Hz by intermittent driving, one frame period is 0.1 second.

Figure 27:
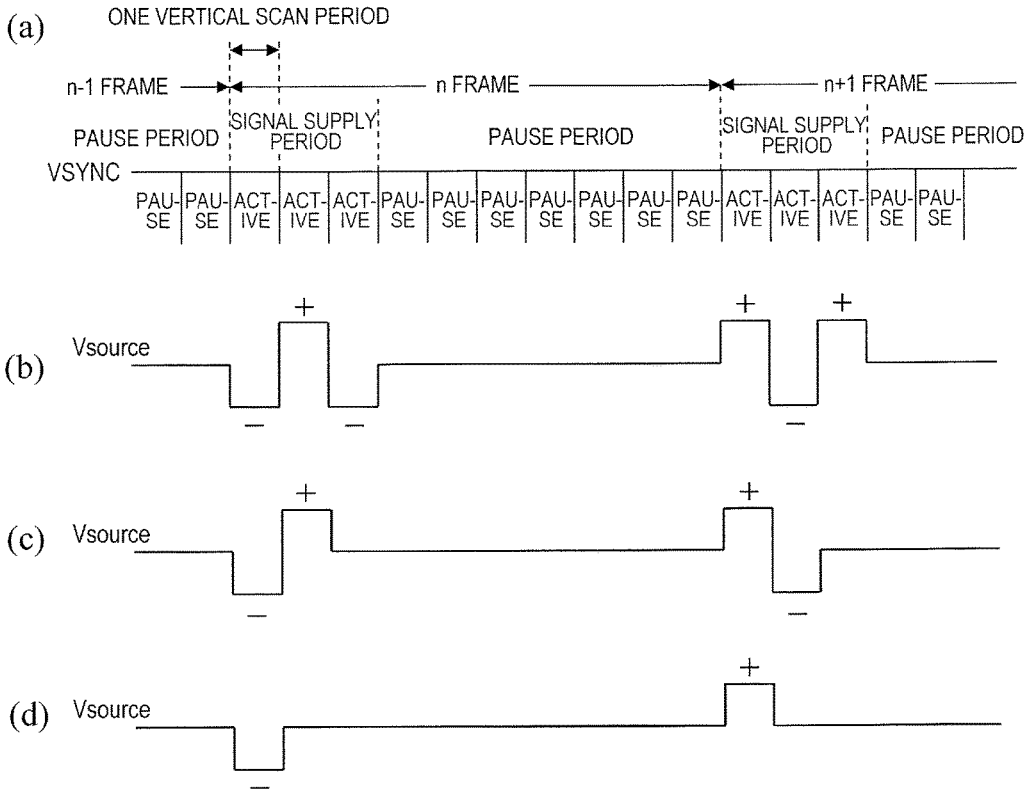
FIG. 27 A chart showing the waveforms of display signal voltages in the intermittent driving in association with the vertical synchronization signal. (a) shows the vertical synchronization signal. (b) illustrates a case where the signal supply period provided in one frame corresponds to three vertical scan periods. (c) illustrates a case where the signal supply period provided in one frame corresponds to two vertical scan periods. (d) illustrates a case where the signal supply period provided in one frame corresponds to one vertical scan periods.

FIGS. 27(*a*) to 27(*d*) show examples of the application timing of display signal voltage Vsource in the intermittent driving (FIGS. 27(*b*) to 27(*d*)) in association with vertical synchronization signal VSYNC (a signal that defines one vertical scan period: FIG. 27(*a*)). As shown in FIG. 27(*a*), in the illustrated form, one frame consists of 10 vertical scan periods.

FIG. 27(*b*) shows a form where the display signal voltage is supplied only in the three vertical scan periods at the leading end of one frame but not supplied in the remaining seven vertical scan periods. Note that FIG. 27(*a*) also shows signal supply periods and pause periods corresponding to display signal voltage Vsource shown in FIG. 27(*b*).

FIG. 27(*c*) shows a form where the display signal voltage is supplied only in the two vertical scan periods at the leading end of the frame, while the remaining vertical scan periods are pause periods. FIG. 27(*d*) shows a form where the display signal voltage is supplied only in the first vertical scan period at the leading end of the frame, while the remaining vertical scan periods are pause periods.

When the liquid crystal display device 100 can carry out the above-described intermittent driving, it is preferred that, in switching between the normal driving (where no pause period is provided in one frame) and the intermittent driving, the polarity reversal mode of the display signal voltage is switched by the polarity reversal driving switching section 41. In an intermittent driving operation, flicker is readily perceived as compared with a normal driving operation. Using in an intermittent driving operation a polarity reversal mode in which the spatial frequency of polarity reversal is shorter than in a polarity reversal mode used in a normal driving operation enables suppression of flicker.

Note that switching of the polarity reversal mode is not necessarily associated with switching of the driving frequency (e.g., switching from the normal driving to the intermittent driving or switching from the intermittent driving to the normal driving). The polarity reversal mode may be switched while the driving frequency is constant. As previously described, the polarity reversal mode includes various modes, and the spatial frequency and phase of polarity reversal are different among these modes. Accordingly, the amount of reduction in power consumption, the degree of suppression of flicker, the killer pattern, etc., are also different. Thus, in view of such, the polarity reversal mode may be switched without association with switching of the driving frequency.

(Oxide Semiconductor TFT)

In the TFT 13 of the liquid crystal display device 100, a semiconductor layer which serves as the active layer may include an oxide semiconductor. Using a semiconductor layer which includes an oxide semiconductor enables to obtain a device characteristic (off characteristic) which is suitable to realization of low frequency driving.

The oxide semiconductor layer provided in the TFT 13 includes, for example, an In—Ga—Zn—O based semiconductor (hereinafter, abbreviated as "In—Ga—Zn—O semiconductor"). Here, the In—Ga—Zn—O semiconductor is a ternary oxide consisting of In (indium), Ga (gallium) and Zn (zinc). The proportion (composition ratio) of In, Ga and Zn is not particularly limited but includes, for example, In:Ga:Zn=2:2:1, In:Ga:Zn=1:1:1, and In:Ga:Zn=1:1:2. In the present embodiment, the oxide semiconductor layer may be an In—Ga—Zn—O semiconductor layer which includes In, Ga and Zn in a proportion of In:Ga:Zn=1:1:1, for example.

A TFT which includes an In—Ga—Zn—O semiconductor layer has high mobility (20 times or more as compared with a-SiTFT) and low current leakage (less than 1/100 as compared with a-SiTFT) and is therefore suitably used as a driver TFT and a pixel TFT. When using the TFT 13 that includes the In—Ga—Zn—O semiconductor layer, the power consumption of the liquid crystal display device 100 can be greatly reduced.

The In—Ga—Zn—O semiconductor may be amorphous or may include a crystalline portion so as to have crystallinity. The crystalline In—Ga—Zn—O semiconductor is preferably a crystalline In—Ga—Zn—O semiconductor in which the c-axis is oriented generally perpendicular to the layer surface. The crystalline structure of such an In—Ga—Zn—O semiconductor is disclosed in, for example, Japanese Laid-Open Patent Publication No. 2012-134475. The entire disclosure of Japanese Laid-Open Patent Publication No. 2012-134475 is incorporated by reference in this specification.

The oxide semiconductor layer may include a different oxide semiconductor instead of the In—Ga—Zn—O semiconductor. Examples of the oxide semiconductor layer may include Zn—O based semiconductors (ZnO), In—Zn—O based semiconductors (IZO (registered trademark)), Zn—Ti—O based semiconductors (ZTO), Cd—Ge—O based semiconductors, Cd—Pb—O based semiconductors, CdO (cadmium oxide), Mg—Zn—O based semiconductors, In—Sn—Zn—O based semiconductors (e.g., $In_2O_3$—$SnO_2$—ZnO), and In—Ga—Sn—O based semiconductors.

(Zigzag Arrangement of TFTs)

A configuration where pixels provided on the left and right sides of each signal line are alternately connected to the signal line every n pixel rows is sometimes referred to as "zigzag (staggered) arrangement". In the liquid crystal display panel 10, such a zigzag arrangement may be used.

For example, when n=1, i.e., when using a zigzag arrangement where pixels Px provided on the left and right sides of each signal line 12 are alternately connected to the signal line every pixel row (for example, such as disclosed in Japanese Laid-Open Patent Publication No. 2001-42287), the 1H dot reversal driving can be carried out without reversing the polarity of a display signal voltage supplied to the signal line 12 within one vertical scan period.

Likewise, when n=2, i.e., when using a zigzag arrangement where pixels Px provided on the left and right sides of each signal line 12 are alternately connected to the signal line every two pixel rows (for example, such as disclosed in WO 2011/007613), the 2H dot reversal driving can be carried out without reversing the polarity of a display signal voltage supplied to the signal line 12 within one vertical scan period.

As a matter of course, a configuration where all the pixels Px connected to each signal line 12 are of the same pixel column, as in conventional common liquid crystal display devices, may be used.

INDUSTRIAL APPLICABILITY

According to an embodiment of the present invention, a liquid crystal display device is provided in which deterioration of the display quality at the timing of switching the polarity reversal mode is suppressed.

REFERENCE SIGNS LIST

10 liquid crystal display panel
11 scan line
12 signal line
13 thin film transistor
14 pixel electrode
20 scan line driving circuit
30 signal line driving circuit
40 display control section
41 polarity reversal driving switching section
42 unreversed pixel identifying section
43 undershoot circuit
44 overshoot circuit
100 liquid crystal display device
110 host
Px pixel

The invention claimed is:

1. A liquid crystal display device, comprising: a liquid crystal display panel having a plurality of pixels arranged in a matrix which has a plurality of rows and a plurality of columns, the liquid crystal display panel having a plurality of scan lines extending in a row direction and a plurality of signal lines extending in a column direction; a scan line driving circuit that supplies a scan signal voltage to each of the plurality of pixels via a corresponding scan line; a signal line driving circuit that supplies a display signal voltage to each of the plurality of pixels via a corresponding signal line; and a display control section including a polarity reversal driving switching section that switches a mode of polarity reversal of the display signal voltage, wherein the display control section is capable of carrying out a voltage adjustment so as to make a largeness of a display signal voltage supplied to the plurality of pixels different from its original largeness, and in a case where the polarity reversal driving switching section switches the mode of polarity reversal of a display signal voltage in transition from a first vertical scan period to a second vertical scan period immediately succeeding the first vertical scan period, a pixel group included in the plurality of pixels to which display signal voltages that have the same polarity in both the first vertical scan period and the second vertical scan period are supplied is referred to as a first pixel group, and a pixel group included in the plurality of pixels to which display signal voltages that have opposite polarities in the first vertical scan period and the second vertical scan period are supplied is referred to as a second pixel group, the display control section is capable of making a voltage adjustment amount for a display signal voltage supplied to the first pixel group in the second vertical scan period and a voltage adjustment amount for a display signal voltage supplied to the second pixel group in the second vertical scan period different from each other;

wherein the display control section makes a largeness of a display signal voltage supplied to the pixel group in the second vertical scan period different from its original largeness by 0.86% or more in terms of transmittance.

2. The liquid crystal display device of claim 1, wherein the liquid crystal display device is capable of carrying out intermittent driving in which a signal supply period where a display signal voltage is supplied to each of the plurality of pixels and a pause period where no display signal voltage is supplied to each of the plurality of pixels are provided within one frame.

3. The liquid crystal display device of claim 2, wherein the liquid crystal display device is capable of being switched between normal driving in which the pause period is not provided in one frame and the intermittent driving, and in switching between the normal driving and the intermittent driving, the polarity reversal driving switching section switches the mode of polarity reversal of a display signal voltage.

4. The liquid crystal display device of claim 1, wherein the liquid crystal display panel includes a thin film transistor provided in each of the plurality of pixels, and the thin film transistor includes a semiconductor layer which includes an oxide semiconductor.

5. The liquid crystal display device of claim 4, wherein the oxide semiconductor includes an In—Ga—Zn—O based semiconductor.

6. The liquid crystal display device of claim 5, wherein the In—Ga—Zn—O based semiconductor includes a crystalline portion.

7. A liquid crystal display device, comprising: a liquid crystal display panel having a plurality of pixels arranged in a matrix which has a plurality of rows and a plurality of columns, the liquid crystal display panel having a plurality of scan lines extending in a row direction and a plurality of signal lines extending in a column direction; a scan line driving circuit that supplies a scan signal voltage to each of the plurality of pixels via a corresponding scan line; a signal line driving circuit that supplies a display signal voltage to each of the plurality of pixels via a corresponding signal line; and a display control section including a polarity reversal driving switching section that switches a mode of polarity reversal of the display signal voltage, wherein in a case where the polarity reversal driving switching section switches the mode of polarity reversal of the display signal voltage in transition from a first vertical scan period to a second vertical scan period immediately succeeding the first vertical scan period, the display control section is capable of making a largeness of a display signal voltage supplied in the second vertical scan period different from its original largeness only for a pixel group included in the plurality of pixels to which display signal voltages that have the same polarity in both the first and second vertical scan periods are supplied;

wherein the display control section makes a largeness of a display signal voltage supplied to the pixel group in the second vertical scan period different from its original largeness by 0.86% or more in terms of transmittance.

8. The liquid crystal display device of claim 7, wherein the display control section is capable of making a largeness of a display signal voltage supplied to the pixel group in the second vertical scan period smaller than its original largeness.

9. The liquid crystal display device of claim 7, wherein the display control section is capable of making a largeness of a display signal voltage supplied to the pixel group in the second vertical scan period greater than its original largeness.

10. The liquid crystal display device of claim 7, wherein the display control section further includes an unreversed pixel identifying section that identifies, from among the plurality of pixels, the pixel group to which display signal voltages that have the same polarity in both the first and second vertical scan periods are supplied.

11. The liquid crystal display device of claim 10, wherein the display control section further includes an undershoot circuit that makes a display signal voltage supplied in the second vertical scan period to the pixel group identified by the unreversed pixel identifying section smaller than its original largeness or an overshoot circuit that makes a display signal voltage supplied in the second vertical scan period to the pixel group identified by the unreversed pixel identifying section greater than its original largeness.

12. The liquid crystal display device of claim 7, wherein the liquid crystal display device is capable of carrying out intermittent driving in which a signal supply period where a display signal voltage is supplied to each of the plurality of pixels and a pause period where no display signal voltage is supplied to each of the plurality of pixels are provided within one frame.

13. The liquid crystal display device of claim 12, wherein the liquid crystal display device is capable of being switched between normal driving in which the pause period is not provided in one frame and the intermittent driving, and in switching between the normal driving and the intermittent driving, the polarity reversal driving switching section switches the mode of polarity reversal of a display signal voltage.

14. The liquid crystal display device of claim 7, wherein the liquid crystal display panel includes a thin film transistor provided in each of the plurality of pixels, and the thin film transistor includes a semiconductor layer which includes an oxide semiconductor.

15. The liquid crystal display device of claim 14, wherein the oxide semiconductor includes an In—Ga—Zn—O based semiconductor.

16. The liquid crystal display device of claim 15, wherein the In—Ga—Zn—O based semiconductor includes a crystalline portion.

* * * * *